US010082326B2

(12) United States Patent
Kim et al.

(10) Patent No.: US 10,082,326 B2
(45) Date of Patent: Sep. 25, 2018

(54) REFRIGERATOR WITH A PLURALITY OF CAPILLARIES

(71) Applicant: LG ELECTRONICS INC., Seoul (KR)

(72) Inventors: Hyuksoon Kim, Seoul (KR); Suwon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 125 days.

(21) Appl. No.: 15/178,783

(22) Filed: Jun. 10, 2016

(65) Prior Publication Data

US 2016/0363360 A1 Dec. 15, 2016

(30) Foreign Application Priority Data

Jun. 12, 2015 (KR) ..... 10-2015-0083571

(51) Int. Cl.
*F25B 49/02* (2006.01)
*F25B 5/02* (2006.01)
(Continued)

(52) U.S. Cl.
CPC ..... *F25B 49/02* (2013.01); *F25B 5/02* (2013.01); *F25B 13/00* (2013.01); *F25B 41/04* (2013.01);
(Continued)

(58) Field of Classification Search
CPC .. F25B 5/02; F25B 41/067; F25B 2600/2511; F25D 11/022
See application file for complete search history.

(56) References Cited

U.S. PATENT DOCUMENTS 6,491,063 B1 * 12/2002 Benatav ..... F25B 41/046 137/625.43
7,934,695 B2 * 5/2011 Sim ..... F16K 11/0743 251/129.12
(Continued)

FOREIGN PATENT DOCUMENTS

CN 1279752 A 1/2001
CN 104508408 A 4/2015
(Continued)

OTHER PUBLICATIONS

Extended European Search Report in European Application No. 16172852.2, dated Feb. 23, 2017, 12 pages (with English translation).
(Continued)

*Primary Examiner* — Jonathan Bradford
(74) *Attorney, Agent, or Firm* — Fish & Richardson P.C.

(57) ABSTRACT

A refrigerator includes a compressor. The refrigerator further includes a condenser. The refrigerator further includes a refrigerating chamber evaporator. The refrigerator further includes a freezing chamber evaporator. The refrigerator further includes a first capillary that is configured to reduce refrigerant pressure. The refrigerator further includes a second capillary that is configured to reduce refrigerant pressure. The refrigerator further includes a third capillary that is configured to reduce refrigerant pressure. The refrigerator further includes a 4-way valve that includes an inlet that is connected to the condenser, a first outlet that is connected to the first capillary, a second outlet that is connected to the second capillary, and a third outlet that is connected to the third capillary, and that is configured to selectively distribute refrigerant to at least one of the first capillary, the second capillary, or the third capillary.

19 Claims, 14 Drawing Sheets

(51) Int. Cl.

| | |
|---|---|
| ***F25B 41/06*** | (2006.01) |
| ***F25D 11/02*** | (2006.01) |
| ***F25B 13/00*** | (2006.01) |
| ***F25B 41/04*** | (2006.01) |
| *F25D 21/04* | (2006.01) |

(52) U.S. Cl.
CPC ..... *F25B 41/067* (2013.01); *F25D 11/022* (2013.01); *F25B 2341/0661* (2013.01); *F25B 2600/25* (2013.01); *F25B 2600/2511* (2013.01); *F25B 2700/02* (2013.01); *F25B 2700/2104* (2013.01); *F25B 2700/2106* (2013.01); *F25D 21/04* (2013.01); *F25D 2700/12* (2013.01); *F25D 2700/122* (2013.01); *F25D 2700/14* (2013.01)

(56) References Cited

U.S. PATENT DOCUMENTS

2002/0134095 A1 9/2002 Temmyo et al.
2007/0028646 A1* 2/2007 Oshitani ..... F25B 40/00 62/500
2007/0137230 A1* 6/2007 Bae ..... F25B 5/04 62/198
2013/0186129 A1* 7/2013 Bae ..... F25D 11/00 62/498
2015/0040591 A1* 2/2015 Lim ..... F25B 5/02 62/118
2015/0059370 A1* 3/2015 Kim ..... F25B 49/027 62/89
2015/0121917 A1* 5/2015 Lee ..... F25B 5/02 62/115
2015/0121918 A1 5/2015 Lee et al.
2015/0121919 A1* 5/2015 Lee ..... F25B 5/02 62/115

FOREIGN PATENT DOCUMENTS

| | | |
|---|---|---|
| CN | 104613698 A | 5/2015 |
| JP | 2015-014373 | 1/2015 |
| KR | 10-2000-0033743 | 6/2000 |
| KR | 10-2004-007032 | 9/2004 |
| KR | 10-2014-0047355 | 4/2014 |
| KR | 10-2014-0113077 | 9/2014 |
| KR | 10-2015-0017182 | 2/2015 |

OTHER PUBLICATIONS

Partial European Search Report issued in European Application No. 16172852.2 dated Nov. 3, 2016, 8 pages.

* cited by examiner

REFRIGERATOR WITH A PLURALITY OF CAPILLARIES

CROSS-REFERENCE TO RELATED APPLICATIONS

Pursuant to 35 U.S.C. § 119(a), this application claims the benefit of earlier filing date and right of priority to Korean Application No. 10-2015-0083571, filed on Jun. 12, 2015, the contents of which is incorporated by reference herein in its entirety.

FIELD

The present disclosure relates to a refrigerator including one compressor and two evaporators.

BACKGROUND

Refrigerator is an apparatus for storing articles in a refrigerating/freezing state. The refrigerator may include a refrigerator body formed with a storage compartment and a freezing cycle apparatus for cooling therein. In general, a machine compartment is formed in a rear region of the refrigerator body, and a compressor and a condenser in the freezing cycle apparatus are provided in the machine compartment.

There are various types of refrigerators, and various criteria for classifying refrigerators. As one of the criteria, the refrigerator may be classified according to the layout of a refrigerating chamber and a freezing chamber. For a top mount type refrigerator, the freezing chamber is disposed on a refrigerating chamber. In case of a bottom freezer type refrigerator, the refrigerating chamber is provided at an upper portion thereof and the freezing chamber is provided at a lower portion thereof. In case of a side by side type refrigerator, the refrigerating chamber and freezing chamber are disposed in a horizontal direction.

In order to implement user's desired various modes, a plurality of evaporators may be provided in the refrigerator. The plurality of evaporators may be driven according to their purposes, respectively, and the cooling performance of the refrigerator may be implemented in various modes. For example, an eco-energy mode for reducing the power consumption of the refrigerator, a differential temperature mode for implementing multiple temperatures in a food storage compartment, and the like may be carried out as a plurality of evaporators are provided therein.

SUMMARY

According to an innovative aspect of the subject matter described in this application, a refrigerator includes a compressor that is configured to compress refrigerant; a condenser that is configured to condense refrigerant; a refrigerating chamber evaporator that is configured to exchange heat with air in a refrigerating chamber by evaporating refrigerant; a freezing chamber evaporator that is configured to exchange heat with air in a freezing chamber by evaporating refrigerant; a first capillary that is configured to reduce refrigerant pressure, and that defines a first refrigerant passage by connecting to the refrigerating chamber evaporator; a second capillary that is configured to reduce refrigerant pressure, and that defines a second refrigerant passage by connecting to the refrigerating chamber evaporator; a third capillary that is configured to reduce refrigerant pressure and that defines a third refrigerant passage by connecting to the refrigerating chamber evaporator; and a 4-way valve that includes an inlet that is connected to the condenser, a first outlet that is connected to the first capillary, a second outlet that is connected to the second capillary, and a third outlet that is connected to the third capillary, and that is configured to selectively distribute refrigerant to at least one of the first capillary, the second capillary, or the third capillary based on opening and closing of the first outlet, the second outlet, or the third outlet.

The refrigerator may include one or more of the following optional features. The first capillary is configured to set a first flow rate of refrigerant flowing to the refrigerating chamber evaporator, the first flow rate being based on a first inner diameter of the first capillary. The second capillary is configured to set a second flow rate of refrigerant flowing to the refrigerating chamber evaporator, the second, different flow rate being based on a second, different inner diameter of the second capillary. An inner diameter of the second capillary is greater than 0.7 mm, and is smaller than an inner diameter of the first capillary. An inner diameter of the first capillary is larger than an inner diameter of the second capillary, and greater than 0.9 mm. The refrigerator further includes a sensing unit that is configured to measure at least one of a temperature of the refrigerating chamber, a temperature of the freezing chamber, a temperature of the outside air, or a humidity of the outside air; and a controller that is configured to control the 4-way valve based on a comparison of one or more measurements by the sensing unit with a reference measurement or a set measurement. The refrigerator is set to a first reference temperature that prevents passage blockage, a second reference temperature that decreases load response time, and a reference humidity that prevents water condensation.

The inner diameter of the second capillary is smaller than an inner diameter of the first capillary. The 4-way valve is configured to open the second outlet based on a temperature of the freezing chamber being above a set temperature of the freezing chamber, based on an ambient temperature being between the first reference temperature and the second reference temperature, and based on an ambient humidity being lower than the reference humidity. The refrigerator is set to a first reference temperature that prevents passage blockage, a second reference temperature that decreases load response time, and a reference humidity that prevents water condensation. The inner diameter of the first capillary is larger than an inner diameter of the second capillary. The 4-way valve is configured to open the first outlet based on a temperature of the freezing chamber being above a set temperature of the freezing chamber, and based on an ambient temperature being less than the first reference temperature or greater than the second reference temperature. The refrigerator further includes a hot line that defines a refrigerant passage between the condenser and the 4-way valve, and that is configured prevent water from condensing on a front portion of the refrigerator body by passing through the front portion of the refrigerator body.

A flow rate of refrigerant flowing through the hot line is set based on an inner diameter of a capillary selected as a refrigerant flow passage by the 4-way valve. The refrigerator is set to a first reference temperature that prevents passage blockage, a second reference temperature that decreases load response time, and a reference humidity that prevents water condensation. The inner diameter of the first capillary is larger than an inner diameter of the second capillary. The 4-way valve is configured to open the first outlet based on a temperature of the freezing chamber being above a set temperature of the freezing chamber, based on an ambient temperature being between the first reference temperature and the second reference temperature, and based on an ambient humidity being above the reference humidity. The 4-way valve includes a valve pad that is configured to distribute refrigerant to the first outlet, the second outlet, and the third outlet by selectively opening or closing the first outlet, the second outlet, and the third outlet by rotating. The valve pad includes a base portion that faces the first outlet, the second outlet, and the third outlet; and a protrusion portion that protrudes from the base portion and that is configured to block at least one of the first outlet, the second outlet, or the third outlet based on rotation of the valve pad.

The valve pad is configured to selectively implement a full closed mode in which the protrusion portion closes the first outlet, the second outlet, and the third outlet, a first mode in which two of the first outlet, the second outlet, or the third outlet are closed, a second mode in which one of the first outlet, the second outlet, or the third outlet is closed, and a third mode in which none of the first outlet, the second outlet, or the third outlet are closed. The protrusion portion includes a first portion that is configured to block the first outlet, a second portion that is configured to block the second outlet, and a third portion that is configured to block the third outlet in the full closed mode. The valve pad defines a recess portion that is located between the first portion and the second portion and that is configured to open the first outlet based on switching from the full closed mode to the second mode. The base portion is divided into a first quadrant that includes the first portion, a second quadrant that includes the second portion, a third quadrant that includes the third portion, and a fourth quadrant, the first quadrant, the second quadrant, the third quadrant, and the fourth quadrant being located sequentially around a center of the base portion.

The first outlet, second outlet, and third outlet are located in the first quadrant, the second quadrant, and the third quadrant, respectively, in the full closed mode. A connection between the second portion and the third portion defines a protrusion from the base portion over a boundary between the second quadrant and the third quadrant and along a circumferential direction. A connection between the first portion and the third portion defines a protrusion that is located in the fourth quadrant and that is smaller than the first portion, the second portion, and the third portion. A second recess portion is located between the protrusion that is located in the fourth quadrant and the first portion. A third recess portion is located between the protrusion that is located in the fourth quadrant and the third portion. The fourth quadrant includes a position setting portion that identifies the fourth quadrant that does not include the first portion, the second portion, or the third portion. The position setting portion is a flat edge on the perimeter of the valve pad. A portion of the first portion is defined by an first arc that is defined by a radius. A portion of the second portion is defined by a second arc that is defined by the radius. A portion of the third portion is defined by the second arc. The second arc is shorter than the first arc. The valve pad defines a hole that is in a center of the valve pad.

An object of the present disclosure is to propose a structure in which a capillary connected to a freezing chamber evaporator is dualized to overcome the limit of a freezing cycle in which capillaries are connected to each evaporator one by one in a refrigerator having one compressor and two evaporators.

Another object of the present disclosure is to provide a structure of a 4-way valve capable of implementing the dualization of a capillary.

Still another object of the present disclosure is to selectively implement (1) an operation for reducing power consumption, (2) a fast load response operation, (3), a passage blockage prevention operation, and (4) a dew condensation prevention operation.

Yet still another object of the present disclosure is to present an operation algorithm of a refrigerator including one compressor, two evaporators and a 4-way valve.

DETAILED DESCRIPTION

Figure 1:
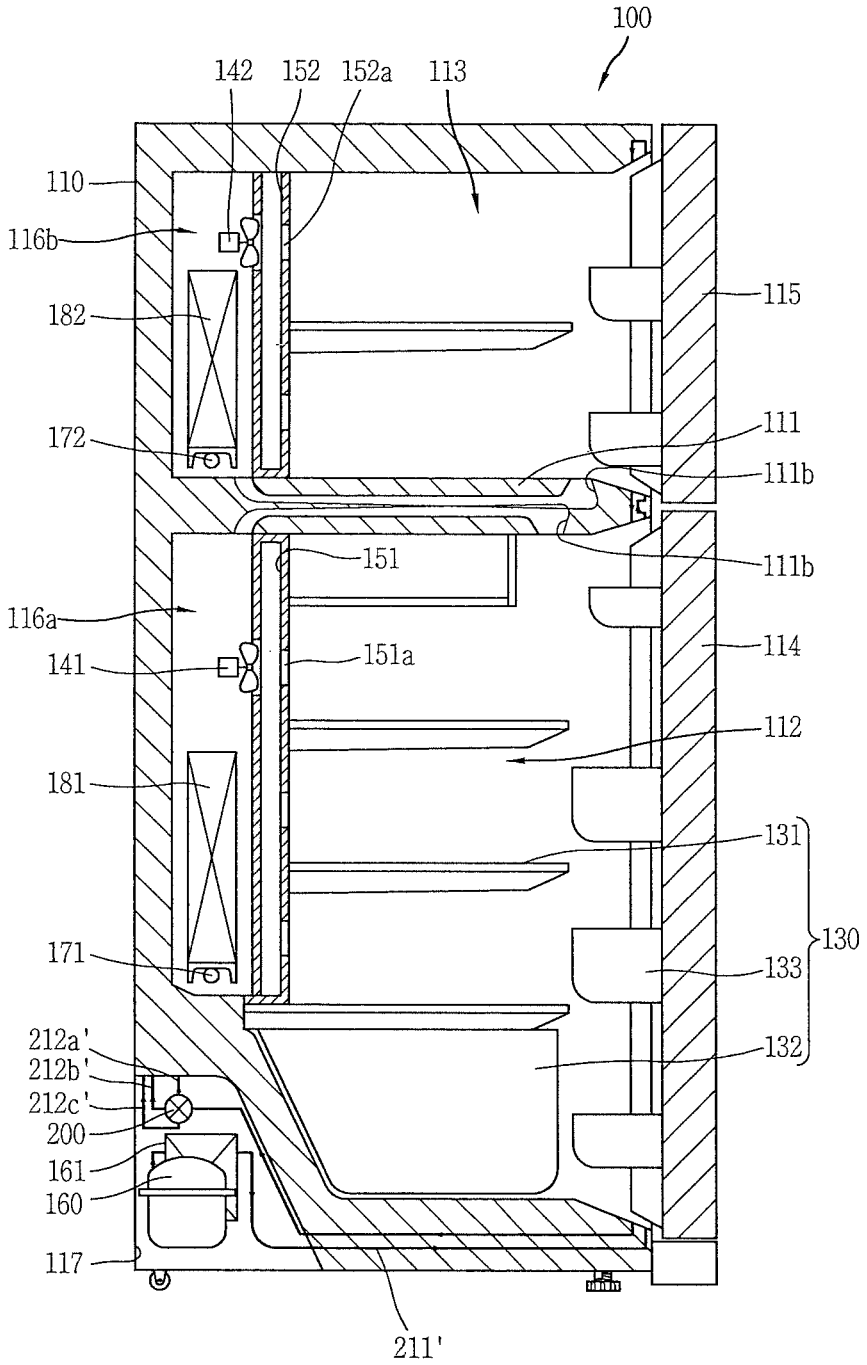
FIGS. 1-3 are conceptual views of example refrigerators.

FIG. 1 illustrates an example refrigerator 100.

The refrigerator 100 refers to an apparatus for keeping foods stored therein at a low temperature using cold air. The cold air is generated by a freezing cycle in which the processes of compression-condensation-expansion-evaporation are sequentially carried out.

A refrigerator body 110 is provided with storage spaces 112 and 113 for storing foods therein. The storage spaces 112 and 113 are separated from each other by a partition wall 111. The storage spaces 112 and 113 may be divided into a refrigerating chamber 112 and a freezing chamber 113.

The refrigerator 100 may be classified into a top mount type, a side by side type, a bottom freezer type, and the like according to the layout of the refrigerating chamber 112 and freezing chamber 113. The top mount type has a structure in which the freezing chamber 113 is disposed on the refrigerating chamber 112. The side by side type has a structure in which the refrigerating chamber and the freezing chamber are disposed in a horizontal direction. The bottom freezer type has a structure in which the refrigerating chamber is disposed on the freezing chamber. Though the top mount type refrigerator 100 is shown in FIG. 1, the present disclosure may not be necessarily limited to this, and may be also applicable to the side by side type and the bottom freezer type.

Doors 114 and 115 are connected to the refrigerator body 110. The doors 114 and 115 are configured to open and close a front opening portion of the refrigerator body 110. According to the present drawing, it is illustrated that a refrigerating chamber door 114 and a freezing chamber door 115 are configured to open and close a front portion of the refrigerating chamber 112 and freezing chamber 113, respectively. The doors 114 and 115 may be configured in various ways such as a rotation type or drawer type. The rotation type is rotatably connected to the refrigerator body 110, and the drawer type is slidably connected to the refrigerator body 110.

At least one of accommodation units 130 (for example, a shelf 131, a tray 132, a basket 133, etc.) for effectively using the storage spaces 112 and 113 therein. For example, the shelf 131 and tray 132 are provided within the refrigerator body 110, and the basket 133 may be provided at an inner side of the doors 114 and 115 corresponding to the refrigerator body 110.

The compression-condensation-expansion-evaporation of refrigerant are sequentially carried out in the freezing cycle of the refrigerator 100. The compression of refrigerant is carried out in the compressor 160. The condensation of refrigerant is carried out in the condenser 161. The expansion of refrigerant is carried out in the capillaries 212*a*', 212*b*', and 212*c*'). The evaporation of refrigerant is carried out in the refrigerating chamber evaporator 181 and freezing chamber evaporator 182 provided in each cooling chamber 116*a* and 116*b*. Accordingly, the compressor 160, capillaries 212*a*', 212*b*', and 212*c*', refrigerating chamber evaporator 181, freezing chamber evaporator 182, and refrigerant passages (for example, hot line 211', etc.) connecting them to each other form the freezing cycle. Other devices may be added to the freezing cycle.

Hereinafter, the constituent elements constituting a freezing cycle according to the flow of refrigerant will be described in a sequential manner. The front, rear, left and right side of the refrigerator 100 and the front, rear, left and right side of the refrigerator body 110 are based on the direction of viewing the doors 114 and 115 in a forward direction from an outside of the refrigerator 100.

A machine compartment 117 is provided at a rear bottom side of the refrigerator body 110. The machine compartment 117 corresponds to a space for installing part of the constituent elements of the freezing cycle. The compressor 160, condenser 161 and the like are installed within the machine compartment 117.

The compressor 160 is configured to compress refrigerant. The refrigerant is compressed at a high pressure by the compressor 160.

The condenser 161 receives refrigerant from the compressor 160. The condenser 161 is configured to condense refrigerator compressed in the compressor 160. In case of ignoring loss, theoretically, refrigerant is condensed while maintaining a constant pressure by the condenser 161.

When the freezing cycle is operated, the temperatures of the refrigerating chamber 112 and freezing chamber 113 are maintained at a low temperature. When the refrigerating chamber 112 and freezing chamber 113 are cooled, the temperature of a front portion of the refrigerator body 110 is reduced below a dew point. Furthermore, moisture in the air may be condensed to form dew on a front portion of the refrigerator body 110, the temperature of which is reduced below a dew point. A hot line 211' for preventing dew from being condensed on a front portion of the refrigerator body 110 is provided in the refrigerator 100.

One end of the hot line 211' is connected to the condenser 161, and the other end thereof is connected to a 4-way valve 200. However, the hot line 211' is not connected to the condenser 161 and 4-way valve 200 in a straight line, but started from the condenser 161 and connected to the 4-way valve 200 through the front portion of the refrigerator body 110. When a direction in which the doors 114 and 115 are installed is referred to as a front side or front portion of the refrigerator body 110, the machine compartment 117 is typically disposed at the front side or front portion of the refrigerator body 110. The hot line 211' is extended from the condenser 161 provided in the machine compartment 117 to the front portion of the refrigerator body 110. At the front portion of the refrigerator body 110, the hot line 211' is extended from the bottom to the top along a circumference of the opening portion the storage spaces 112 and 113, and returned from the top to the bottom again and connected to the 4-way valve 200 of the machine compartment 117.

The hot line 211' corresponds to a passage through which refrigerant flows. The hot line 211' forms a refrigerant passage for preventing dew from being condensed on the front portion of the refrigerator body 110. The refrigerant flows from the condenser 161 to the 4-way valve 200 through the front portion of the refrigerator body 110 along the hot line 211'.

When the refrigerating chamber 112 and freezing chamber 113 are maintained at a low temperature by the operation of the freezing cycle, the front portion of the refrigerator body 110 has an effect by the refrigerating chamber 112 and freezing chamber 113. Accordingly, the temperature of refrigerant flowing through the hot line 211' is higher than that of the front portion of the refrigerator body 110. Heat is transferred from high temperature to low temperature, and refrigerant supplies heat to the front portion of the refrigerator body 110 while flowing through the hot line 211'. The front portion of the refrigerator body 110 may maintain a temperature above a dew point by heat supplied from refrigerant flowing through the hot line 211', thereby preventing dew from being condensed on the front portion of the refrigerator body 110.

The 4-way valve 200 may be provided in the machine compartment 117. The machine compartment 117 is referred to as 4-way in the meaning of being connected to four passages. The 4-way valve 200 has one inlet and three outlets. Each of the inlet and outlets communicates with a different passage.

An inlet of the 4-way valve 200 is connected to the condenser 161. Since the hot line 211' is provided between the 4-way valve 200 and the condenser 161, the inlet of the 4-way valve 200 is connected to the condenser 161 through the hot line 211'. However, the addition of another constituent element other than the hot line 211's between the 4-way valve 200 and the condenser 161 is not excluded. The 4-way valve 200 receives refrigerant discharged from the condenser 161 through the hot line 211'.

The outlets of the 4-way valve 200 are connected to capillaries 212*a*', 212*b*', and 212*c*'. The 4-way valve 200 may include a first through a third outlet 212*a*, 212*b*, and 212*c* (refer to FIG. 6), and the capillaries 212*a*', 212*b*', and 212*c*' may include a first capillary 212*a*' through a third capillary 212*c*'. The first outlet 212*a* (refer to FIG. 6) is connected to the first capillary 212*a*', and the second outlet 212*b* (refer to FIG. 6) is connected to the second capillary 212*b*', and the third outlet 212*c* (refer to FIG. 6) is connected to the third capillary 212*c*'. The 4-way valve 200 selectively distributes refrigerant to at least one of the first through the third capillaries 212*a*', 212*b*', and 212*c*' through a selective opening and closing of the first through the third outlet 212*a*, 212*b*, and 212*c*.

The capillaries 212*a*', 212*b*', and 212*c*' are configured to reduce a pressure of refrigerant condensed in the condenser 161. The first capillary 212*a*' and the second capillary 212*b*' are connected to the freezing chamber evaporator 182 to form different refrigerant passages. The third capillary 212*c*' is connected to the refrigerating chamber evaporator 181 to form a refrigerant passage. Three refrigerant passages distinguished from one another by the first through the third capillaries 212*a*', 212*b*', and 212*c*' are formed in the freezing cycle. Refrigerant is expanded while passing through a capillary (at least one of the capillaries 212*a*', 212*b*', and 212*c*') selected as a refrigerant flow passage by the 4-way valve 200.

A cooling chamber 116*a* is provided at a rear side of the refrigerating chamber 112. A cooling chamber 116*b* is also provided at a rear side of the freezing chamber 113. Two cooling chambers 116*a* and 116*b* are separated from each other. The evaporators 181 and 182 are provided one by one for each of the cooling chambers 116*a* and 116*b*. In this specification, the evaporator 181 provided in the cooling chamber 116*a* of the refrigerating chamber 112 is referred to as a refrigerating chamber evaporator 181, and the evaporator 182 provided in the cooling chamber 116*b* of the freezing chamber 113 is referred to as a freezing chamber evaporator 182 in order to distinguish the two evaporators 181 and 182.

When the third capillary 212*c*' is selected as a refrigerant flow passage by the operation of the 4-way valve 200, the refrigerating chamber evaporator 181 receives refrigerant through the third capillary 212*c*'. The refrigerating chamber evaporator 181 exchanges heat with the air (cold air) of the refrigerating chamber 112 to evaporate refrigerant.

When at least one of the first capillary 212*a*' and second capillary 212*b*' are selected as a refrigerant flow passage by the operation of the 4-way valve 200, the freezing chamber evaporator 182 receives refrigerant through the first capillary 212*a*' and/or second capillary 212*b*'. The freezing chamber evaporator 182 exchanges heat with the air (cold air) of the freezing chamber 113 to evaporate refrigerant.

The refrigerant evaporated in the refrigerating chamber evaporator 181 and freezing chamber evaporator 182 returns to the compressor 160. The freezing cycle is configured with a closed passage (refer to FIG. 4), the refrigerant continuously circulates through the closed freezing cycle.

Hereinafter, a configuration associated with the flow of the cold air of the refrigerating chamber 112 and the cold air of the freezing chamber 113 will be described.

The air (cold air) of the refrigerating chamber 112 is cooled through heat exchange with refrigerant in the refrigerating chamber evaporator 181. A fan-motor assembly 141 for assisting the flow of cold air may be provided at an upper side of the refrigerating chamber evaporator 181.

The air (cold air) of the freezing chamber 113 is cooled through heat exchange with refrigerant in the freezing chamber evaporator 182. A fan-motor assembly 142 for assisting the flow of cold air may be also provided at an upper side of the freezing chamber evaporator 182.

A refrigerating chamber return duct 111*a* and a freezing chamber return duct 111*b* are formed on the partition wall 111. The refrigerating chamber return duct 111*a* forms a passage for inhaling and returning the air of the refrigerating chamber 112 to a side of the cooling chamber 116*a*. Similarly, the freezing chamber return duct 111*b* forms a passage for inhaling and returning the air of the freezing chamber 113 to a side of the cooling chamber 116*b*. Cold air ducts 151, 152 having a plurality of cold air discharge ports 151*a*, 152*a*, respectively, may be provided between the refrigerating chamber 112 and the cooling chamber 116*a*, and between the freezing chamber 113 and the cooling chamber 116*b*.

The air of the refrigerating chamber 112 is inhaled into the cooling chamber 116*a* through the refrigerating chamber return duct 111*a*. The air inhaled into the cooling chamber 116*a* exchanges heat with the refrigerating chamber evaporator 181 to be cooled. The cooled air is discharged again to the refrigerating chamber 112 through the cold air discharge port 151*a*. The air of the refrigerating chamber 112 repeats the processes of inhalation, cooling and discharge.

The air of the freezing chamber 113 is also inhaled into the cooling chamber 116*b* through the freezing chamber return duct 111*b*. The air inhaled into the cooling chamber 116*b* exchanges heat with the freezing chamber evaporator 182 to be cooled. The cooled air is discharged again to the freezing chamber 113 through the cold air discharge port 151*a*. The air of the freezing chamber 113 repeats the processes of inhalation, cooling and discharge.

Frost may be formed on a surface of the evaporators 181 and 182 by a temperature difference to circulation air reintroduced through the refrigerating chamber return duct 111*a* or freezing chamber return duct 111*b*. Defrost devices 171, 172 are provided in each evaporator 181 and 182 to remove frost.

The refrigerator 100 may include a sensing unit configured to measure at least one of a temperature and a humidity of the outside air. The sensing unit provides criteria for determining whether or not the refrigerator 100 is normally operated and criteria for a method of operating the refrigerator 100. The present disclosure dualizes the capillaries 212*a*' and 212*b*' connected to, particularly the freezing chamber evaporator 182.

The reason of dualizing the capillaries 212*a*' and 212*b*' is to implement various modes of the refrigerator 100 based on the temperature and humidity measured by the sensing unit and obtain an effect of power consumption reduction or fast load response from them. In particular, the reason of dualizing capillaries connected to the freezing chamber evaporator 182 but not dualizing a capillary connected to the refrigerating chamber evaporator 181 is that an effect of power consumption at a side of the freezing chamber is larger than that of the refrigerating chamber.

The temperature measured by the sensing unit may include a temperature of the refrigerating chamber, a temperature of the freezing chamber, and a temperature of the outside air. In order to measure the temperature and humidity, the sensing unit may include a refrigerating chamber thermometer, an outside air temperature, and an outside air hygrometer. The refrigerating chamber thermometer is configured to measure a temperature of the refrigerating chamber. The freezing chamber thermometer is configured to measure a temperature of the freezing chamber. The outside air thermometer is configured to measure a temperature of the outside air. The outside air hygrometer is configured to measure a humidity of the outside air. The installation locations of each thermometer and hygrometer in the present disclosure may not be particularly limited.

The refrigerator 100 of the present disclosure may include one compressor 160 and two evaporators 181 and 182, and particularly, the capillaries 212*a*' and 212*b*' connected to the freezing chamber evaporator 182 are dualized into a first capillary 212*a*' and a second capillary 212*b*'. The present disclosure should be distinguished from a structure having a compressor for each evaporator, in that the refrigerator 100 includes one compressor 160 and two evaporators 181 and 182. Furthermore, the present disclosure should be distinguished from a structure having a unified capillary including only a 3-way valve, in that the refrigerator 100 includes the 4-way valve 200 and capillaries 212*a*' and 212*b*' corresponding to the freezing chamber evaporator 182 are dualized.

FIG. 1 illustrates an example refrigerator in a cross-sectional view, and thus part of the configuration of a freezing cycle is eliminated. Hereinafter, the configuration of a freezing cycle provided in a refrigerator according to the present disclosure will be described in more detail with reference to FIGS. 2 through 4.

Figure 2:
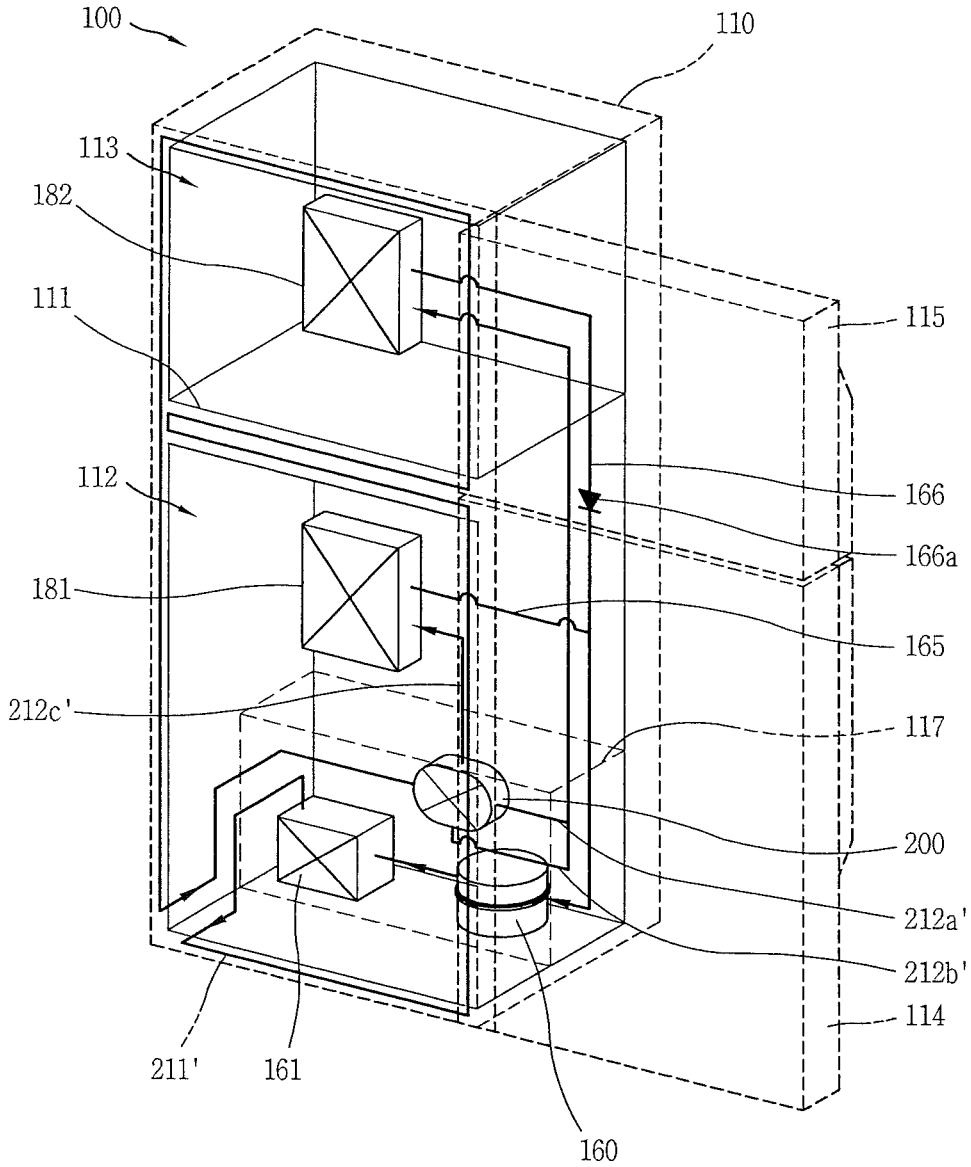
Figure 3:
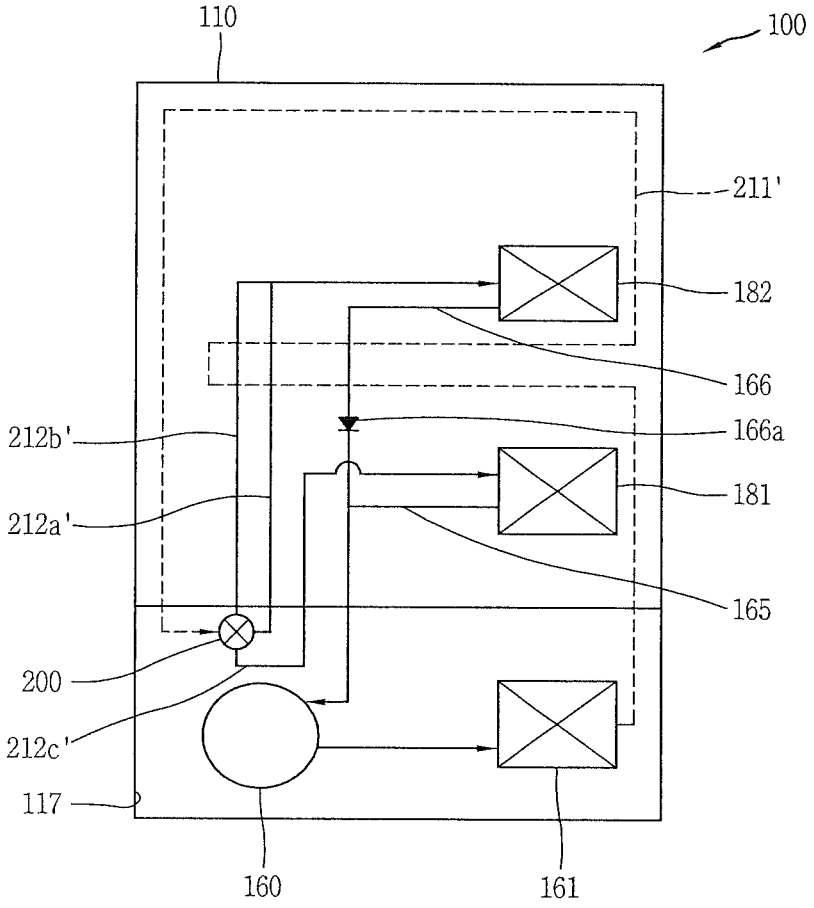

FIGS. 2 and 3 illustrate example refrigerators 100. FIGS. 2 and 3 illustrate a view excluding the configurations having a low relevance to the freezing cycle among the configurations illustrated in FIG. 1. FIGS. 2 and 3 are illustrated in different forms for the sake of convenience of understanding.

The compressor 160 and condenser 161 provided in the machine compartment 117 are connected to each other by a refrigerant passage. Refrigerant is compressed in the compressor 160 and then condensed in the condenser 161. The hot line 211' is connected to the condenser 161, and extended toward a front portion of the refrigerator body 110 out of the machine compartment 117. The hot line 211' is formed along the front portion of the refrigerator body 110. It may be also said that the hot line 211' formed along a circumference of the opening portion of the storage spaces 112 and 113.

The hot line 211' is formed to pass through most of the front portion of the refrigerator body 110 while being extended in horizontal and vertical directions. For example, referring to FIG. 2, the hot line 211' may be formed on a circumference of the opening portion of the refrigerating chamber 112 and a circumference of the freezing chamber 113, and may also pass through the partition wall 111. The hot line 211' passes through the front portion of the refrigerator body 110 and directs toward the 4-way valve 200 provided in the machine compartment 117. The other end of the hot line 211' is connected to an inlet of the 4-way valve 200.

In this manner, heat may be uniformly supplied to the front portion of the refrigerator body 110 by the hot line 211' passing through the refrigerator body 110. Furthermore, heat supplied from refrigerant flowing through the hot line 211' may prevent dew from being condensed on the front portion of the refrigerator body 110. According to the present disclosure, it is sufficient for the hot line 211' to form a refrigerant passage for preventing dew from being condensed on a surface of the refrigerator body 110, and the detailed shape or structure thereof may not be necessarily limited to this.

The 4-way valve 200 is configured to distribute refrigerant. The 4-way valve 200 distributes refrigerant introduced into an inlet through the hot line 211' to the first through the third capillaries 212*a*', 212*b*', and 212*c*'.

The distribution of refrigerant due to the 4-way valve 200 is optional. The 4-way valve 200 may distribute refrigerant to only one of the first through the third capillaries 212*a*', 212*b*', and 212*c*' or distribute refrigerant to only two of the first through the third capillaries 212*a*', 212*b*', and 212*c*' or distribute refrigerant to all the first through the third capillaries 212*a*', 212*b*', and 212*c*'.

The distribution of refrigerant due to the 4-way valve 200 may be carried out by the controller (referred to as a micom) of the refrigerator. The controller controls the operation of the 4-way valve 200 according to a preset plan based on a change of temperatures or humidities measured by the sensing unit. The criteria for controlling the operation of the 4-way valve 200 may be input in advance to the controller.

The refrigerant is distributed to the first through the third capillaries 212*a*', 212*b*', and 212*c*' by the operation of the 4-way valve 200, and as a result, the present disclosure may implementing various operation modes of the refrigerator 100. The operation mode of the refrigerator 100 may be distinguished by a flow rate of refrigerant circulating through the freezing cycle. The operation mode of the refrigerator 100 implemented by the present disclosure may include a power consumption reduction operation, a fast load response operation, a passage blockage prevention operation, a dew condensation prevention operation, and the like. Each of the operations will be described later.

The third capillary 212*c*' is connected to the refrigerating chamber evaporator 181. The third capillary 212*c*' forma a refrigerant passage for allowing refrigerant to flow through the refrigerating chamber evaporator 181. The refrigerant distributed to the third capillary 212*c*' by the operation of the 4-way valve 200 flows into the refrigerating chamber evaporator 181 through the third capillary 212*c*'.

The first capillary 212*a*' and second capillary 212*b*' are connected to the freezing chamber evaporator 182. The first capillary 212*a*' and second capillary 212*b*' form different refrigerant passages for allowing refrigerant to flow through the freezing chamber evaporator 182. As illustrated in FIGS. 2 and 3, the first capillary 212*a*' and second capillary 212*b*' may be joined into one passage at any one point prior to being connected to the freezing chamber evaporator 182 and then connected to the freezing chamber evaporator 182. In some implementations, the first capillary 212*a*' and second capillary 212*b*' may be connected to the freezing chamber evaporator 182, respectively, without being joined into one. The refrigerant distributed to the first capillary 212*a*' by the operation of the 4-way valve 200 flows to the freezing chamber evaporator 182 through the first capillary 212*a*', and the refrigerant distributed to the second capillary 212*b*' flows to the freezing chamber evaporator 182 through the second capillary 212*b*'.

A first suction pipe 165 is connected to the refrigerating chamber evaporator 181 and compressor 160. The refrigerant evaporated from the refrigerating chamber evaporator 181 returns to the compressor 160 through the first suction pipe 165. A second suction pipe 166 is connected to the freezing chamber evaporator 182 and compressor 160. The refrigerant evaporated from the freezing chamber evaporator 182 returns to the compressor 160 through the second suction pipe 166. As illustrated in FIGS. 2 and 3, the first suction pipe 165 and second suction pipe 166 may be joined to each other at any one point.

When the refrigerant started from the compressor 160 returns to the compressor 160, the refrigerant circulates through the freezing cycle once. However, the circulation of refrigerant may not be limited to one circulation, and continuously repeated at every time point that requires the operation of the freezing cycle.

A check valve 166*a* for preventing the backflow of refrigerant may be provided in the second suction pipe 166. Since an operation pressure of the refrigerating chamber evaporator 181 is higher than that of the freezing chamber evaporator 182, there is a concern that refrigerant flowing from the first suction pipe 165 to the compressor 160 may flow back to the second suction pipe 166. The check valve 166*a* is configured to allow only a flow in one direction but suppress a flow in an opposite direction. Accordingly, the check valve 166*a* provided in the second suction pipe 166 may suppress a flow of refrigerant flowing back to the second suction pipe 166 from the first suction pipe 165.

Figure 4:
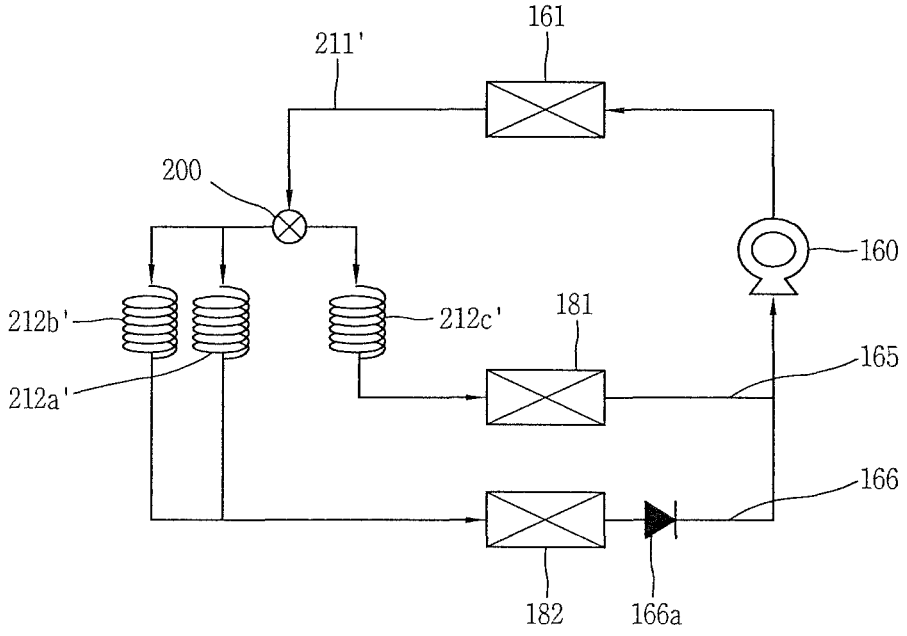
FIG. 4 is a conceptual view of an example freezing cycle of a refrigerator.

FIG. 4 illustrates an example freezing cycle of a refrigerator 100.

Most of the freezing cycle has been described above in FIGS. 1 through 3. Hereinafter, operation modes that can be implemented using the 4-way valve 200 and a dualized capillary and an effect that can be obtained through the implementation of the operation modes will be described.

As described above, the present disclosure has a structure in which a single freezing cycle has one compressor 160 and two evaporators. Dualized capillaries connected to the freezing chamber evaporator 182 is implemented by the 4-way valve 200. If the present disclosure includes a 3-way valve other than the 4-way valve 200, then the capillaries of the freezing cycle having one compressor 160 and two evaporators cannot be dualized. The 3-way valve may have one inlet and two outlets, and the two outlets may be connected to two evaporator, respectively, one to one.

A flow rate of refrigerant flowing through the freezing chamber evaporator 182 is set according to an inner diameter of the capillary selected to flow refrigerant between the first capillary 212*a*' and second capillary 212*b*'. It is because a flow rate of refrigerant flowing through the evaporator increases as the inner diameter of the capillary increases but a flow rate of refrigerant flowing through the evaporator decreases as the inner diameter of the capillary decreases. The selection is determined by the operation of the 4-way valve 200.

The dualized first capillary 212*a*' and second capillary 212*b*' have different inner diameters to differentially set a flow rate of refrigerant flowing through the freezing chamber evaporator 182. The third capillary 212*c*' connected to the refrigerating chamber evaporator 181 is unified, and thus it is impossible to differentially set a flow rate of refrigerant flowing to the refrigerating chamber evaporator 181. However, the dualized first capillary 212*a*' and second capillary 212*b*' are connected to the freezing chamber evaporator 182, and thus a flow rate of refrigerant flowing to the freezing chamber evaporator 182 may be differentially set according to the refrigerant flowing to which one of the two capillaries 212*a*', 212*b*'.

The ordinal numbers assigned to the first capillary 212*a*' and second capillary 212*b*' are to distinguish them from each other. According to the present disclosure, the first capillary 212*a*' and second capillary 212*b*' have different sizes of inner diameters. Hereinafter, for the sake of convenience of explanation, it will be described on the assumption that the second capillary 212*b*' has a smaller inner diameter than that of the first capillary 212*a*'.

Since an inner diameter of the second capillary 212*b*' is smaller than that of the first capillary 212*a*', a flow rate of refrigerant flowing through the second capillary 212*b*' is lower than that of the first capillary 212*a*'. It is because the flow rate of refrigerant is determined by the inner diameter of a passage through which refrigerant flows. The first capillary 212*a*' and second capillary 212*b*' are selected as refrigerant flow passages by the operation of the 4-way valve 200, wherein a flow rate of refrigerant flowing to the freezing chamber evaporator 182 is lower when the refrigerant flows through the first capillary 212*a*' than that when the refrigerant flows through the second capillary 212*b*'.

The freezing cycle is configured with a closed passage, and thus when it is controlled to increase a flow rate of refrigerant flowing through the freezing chamber evaporator 182, a flow rate of refrigerant flowing through the compressor 160, condenser 161 and hot line 211' also increases. In some implementations, when it is controlled to decrease a flow rate of refrigerant flowing through the freezing chamber evaporator 182, a flow rate of refrigerant flowing through the compressor 160, condenser 161 and hot line 211' also decreases. As described above, the capillaries 212*a*' and 212*b*' having different inner diameters and the 4-way valve 200 may adjust a flow rate of refrigerant circulating through the freezing cycle by their associated operations.

However, a total amount of refrigerant existing in the freezing cycle does not theoretically change unless there is a leakage. Accordingly, an increase or decrease of the circulation flow rate of refrigerant should be distinguished from a change of the total amount of refrigerant. When the first capillary 212*a*' is selected by the operation of the 4-way valve 200 to increase an amount of refrigerant circulating the freezing cycle, an amount of stagnant refrigerant without circulating the freezing cycle decreases to maintain the total amount of refrigerant. In some implementations, when the second capillary 212*b*' is selected by the operation of the 4-way valve 200 to decrease an amount of refrigerant circulating the freezing cycle, an amount of stagnant refrigerant without circulating the freezing cycle increases to maintain the total amount of refrigerant.

A flow rate of refrigerant circulating the freezing cycle exerts an effect on the power consumption of the freezing cycle. When a flow rate of refrigerant circulating the freezing cycle decreases, the operation rate of the freezing cycle or the like may be reduced. Accordingly, it may be possible to reduce the power consumption of the freezing cycle.

In some implementations, when a flow rate of refrigerant circulating the freezing cycle increases, the power consumption of the freezing cycle increases, but it may be possible to quickly respond to a load required for the refrigerator 100. A load required for the refrigerator 100 may be understood as a level at which refrigeration or freeze is required, and a high load denotes requiring higher cooling power.

A flow rate of refrigerant circulating the freezing cycle is determined by the 4-way valve 200 and capillaries 212*a*', 212*b*', and 212*c*'. Accordingly, the 4-way valve 200 and the first capillary 212*a*' and second capillary 212*b*' having different inner diameters may implement a power consumption reducing operation, a fast load response operation, and the like. In addition, the 4-way valve 200, the first capillary 212*a*' and second capillary 212*b*' may implement a dew blockage prevention operation and a dew condensation prevention operation.

Describing the detailed operation of the freezing cycle, when the supply of refrigerant to the freezing chamber evaporator 182 is required but especially high cooling is not required, the second capillary 212*b*' may be selected as a refrigerant flow passage by the 4-way valve 200. When the second capillary 212*b*' is selected as a refrigerant flow passage, a flow rate of refrigerant circulating the freezing cycle may decrease to reduce the power consumption of the freezing cycle.

In some implementations, when a fast load response is required through high cooling, the first capillary 212*a*' may be selected as a refrigerant flow passage by the 4-way valve 200. When the first capillary 212*a*' having a larger inner diameter than that of the second capillary 212*b*' is selected, sufficient refrigerant may flow to quickly reduce the temperature of the freezing chamber 113 (refer to FIGS. 1 through 3).

As an inner diameter of the capillary decreases, the effect of power consumption reduction increases. Accordingly, in order to maximize the effect of power consumption reduction, the inner diameter of the second capillary 212*b*' should be small as much as possible. However, a too small inner diameter may induce a passage blockage phenomenon. In consideration of this, according to the present disclosure, the second capillary 212*b*' has an inner diameter above 0.7 mm. Of course, the second capillary 212*b*' has a smaller inner diameter than that of the first capillary 212*a*'.

In order to carry out a fast load response, the inner diameter of the capillary should be sufficiently large. It is because as the inner diameter of the capillary increases, a large amount of refrigerant circulates to more quickly cool the freezing cycle. For the purpose of carrying out a fast load response, the first capillary 212*a*' and second capillary 212*b*' has an inner diameter above 0.9 mm. However, when the inner diameter of the capillary increases without any limitation, it may lose its inherent function. Accordingly, the inner diameter of the first capillary 212*a*' should be determined within a range of not losing its inherent function. Of course, the first capillary 212*a*' has a larger inner diameter than that of the second capillary 212*b*'.

The refrigerant selectively flows to the first through the third capillaries 212*a*', 212*b*', and 212*c*' by the operation of the 4-way valve 200. Hereinafter, the structure of the 4-way valve 200 for distributing refrigerant to the first through the third capillaries 212*a*', 212*b*', and 212*c*' will be described.

Figure 5:
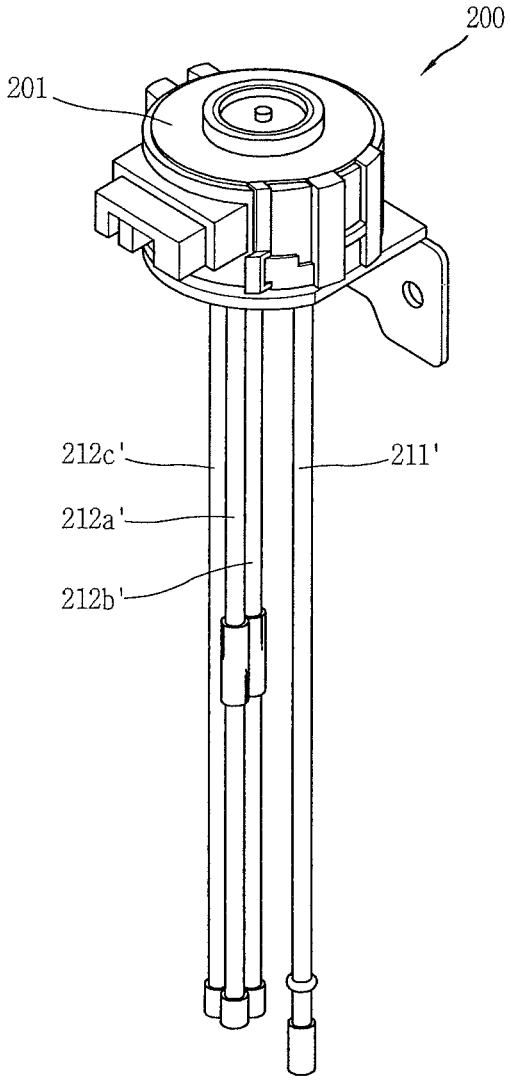
FIG. 5 is a perspective view of an example 4-way valve of a refrigerator.

FIG. 5 illustrates an example 4-way valve 200.

A case 201 may form an appearance of the 4-way valve 200, and the other constituent elements of the 4-way valve 200 are accommodated into the first region 201. The appearance of the case 201 may have a shape for being placed into the machine compartment 117 (refer to FIGS. 1 through 3), but the present disclosure does not particularly limit the appearance of the case 201.

The hot line 211' and the first through the third capillaries 212*a*', 212*b*', and 212*c*' are connected to the 4-way valve 200. The hot line 211' is connected to one lower side of the 4-way valve 200, and the first through the third capillaries 212*a*', 212*b*', and 212*c*' are connected to the other lower side of.

The 4-way valve 200 is connected to one hot line 211' and three first through the third capillaries 212*a*', 212*b*', and 212*c*' to selectively distribute refrigerant to each capillary 212*a*', 212*b*', and 212*c*'. The 4-way valve 200 has been referred to as a 4-way valve 200 in the meaning of being connected to total four inlet and outlet pipes 211', 212*a*', 212*b*', and 212*c*'. The inlet and outlet pipes 211', 212*a*', 212*b*', and 212*c*' are defined as a concept including the hot line 211' and the first through the third capillaries 212*a*', 212*b*', and 212*c*'.

The first through the third outlets 212*a*, 212*b*, and 212*c* (refer to FIG. 6) indicate a portion through which refrigerant is discharged from the 4-way valve 200 to the first through the third capillaries 212*a*', 212*b*', and 212*c*'. The more detailed internal structure of the 4-way valve 200 will be described with reference to FIGS. 6 and 7.

Figure 6:
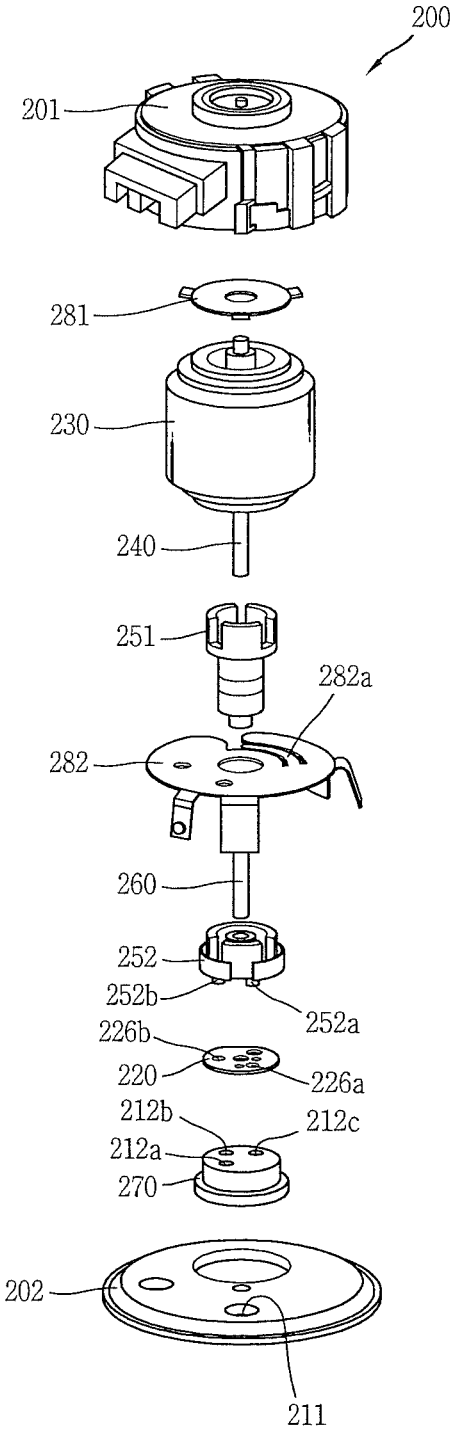
FIG. 6 is an exploded perspective view of an example 4-way valve.
Figure 7:
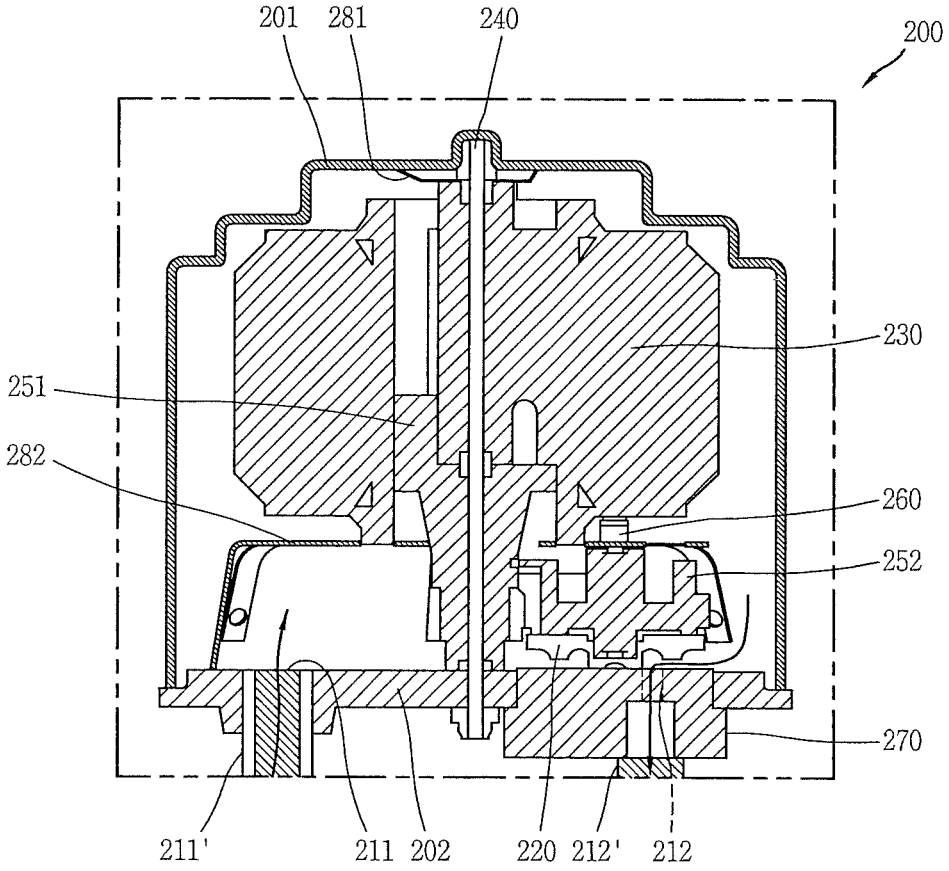
FIG. 7 is a cross-sectional view of an example 4-way valve.

FIGS. 6 and 7 illustrate example 4-way valves 200.

The 4-way valve 200 may include an inlet 211 and outlets 212*a*, 212*b*, and 212*c*. The inlet 211 of the 4-way valve 200 is connected to the condenser 161 (refer to FIGS. 1 through 4) by the hot line 211'. The outlets 212*a*, 212*b*, and 212*c* are connected to the first through the third capillaries 212*a*', 212*b*', and 212*c*', respectively. The 4-way valve 200 selectively distributes refrigerant to at least one of the first through the third capillaries 212*a*', 212*b*', and 212*c*' according to the opening and closing of the outlets 212*a*, 212*b*, and 212*c*.

Referring to FIGS. 4 and 5, the 4-way valve 200 may include a case 201, a plate 202, a valve pad 220, a rotor 230, a first spur gear 251, a second spur gear 252, a boss 270, a first leaf spring 281, and a second leaf spring 282. The configuration is optional, and thus it may be also allowed to have a larger number of constituent elements as well as all the foregoing constituent elements may not be required for the 4-way valve 200 of the present disclosure.

The appearance of the 4-way valve 200 is formed by the case 201 and the plate 202.

The case 201 is configured to accommodate the constituent elements of the 4-way valve 200 as described above, and formed to support each constituent element. At least part of the case 201 may be formed in an open shape. The case 201 may be configured to secure a layout space of the first spur gear 251 and second spur gear 252.

The plate 202 is coupled to a lower portion of the case 201 to form a bottom portion of the 4-way valve 200. Accordingly, the plate 202 is formed to correspond to an open portion of the case 201. The hot line 211', first shaft 240 and boss 270 are inserted into the plate 202. The first shaft 240 substantially passes through a central portion of the plate 202, and the hot line 211' and boss 270 may be disposed at different sides based on the first shaft 240. The plate 202 may have several holes for accommodating the hot line 211', first shaft 240 and boss 270.

During the process of allowing refrigerant to flow into the 4-way valve 200 through the hot line 211' and inlet 211 and flow out through the capillaries 212*a*', 212*b*', and 212*c*', it is not required to prevent the leakage of refrigerant from the 4-way valve 200. In order to prevent the leakage of refrigerant, a sealing member may be provided at a coupling portion between the case 201 and the plate 202, a coupling portion between the plate 202 and the hot line 211', a coupling portion between the plate 202 and the first shaft 240, a coupling portion between the plate 202 and the boss 270, and the like.

The rotor 230 is disposed at an upper portion of an inner space of the case 201. The rotor 230 is configured to rotate by an electromagnetic interaction with a stator. The stator may be disposed at an outside of the case 201 but also disposed at an inside of the case 201. The stator may be configured to surround at least part of the case 201, and there may be a gap between the case 201 and the stator.

A motor including the rotor 230 and the stator generates a rotational force according to a voltage applied thereto. In particular, a stepping motor may be used to adjust the rotation angle. A stepping motor indicates a motor in which a sequence is provided to pulses in a step state to rotate it as much as an angle in proportion to a given number of pulses. The stepping motor may rotate the rotor 230 in a unipolar mode or the like.

In a stepping motor, a step of the pulse is proportional to a rotation angle, and thus the rotation angle of the rotor 230 can be accurately controlled using the stepping motor. Furthermore, when the rotation angle of the rotor 230 is controlled, it may be also possible to accurately control the rotation angle of the first spur gear 251 connected to the rotor 230, the second spur gear 252 rotating in engagement with the first spur gear 251 and the valve pad 220 connected to the second spur gear 252. Furthermore, when the stepping motor is used, it may be possible to implement a forward rotation, a reverse rotation with an opposite direction to the forward rotation, and a stop of the rotor 230 at a rotation angle desired to stop.

When a voltage is applied to the motor, the rotor 230 rotates around the first shaft 240. The first shaft 240 supports the rotor 230 and first spur gear 251, and disposed at a central portion of the 4-way valve 200. The first shaft 240 may be extended from a knob portion of the case 201 to the plate 202.

The first spur gear 251 is formed to receive a rotational force from the rotor 230, and rotates around the first shaft 240 along with the rotor 230. The first spur gear 251 is disposed at a lower portion of the rotor 230, and at least part thereof may be formed to be coupled to the rotor 230. The first spur gear 251 may be extended in a direction in parallel to the first shaft 240, and extended to a position adjacent to the plate 202.

The second spur gear 252 is disposed at one side of the first spur gear 251 to rotate in engagement with the first spur gear 251. The second spur gear 252 is configured to rotate around the second shaft 260, and the first shaft 240 and the second shaft 260 may be substantially in parallel. The second shaft 260 passes through the second spur gear 252. The second spur gear 252 and the valve pad 220 are supported by the second shaft 260.

The first spur gear 251 and second spur gear 252 are engaged with each other, and when the rotor 230 rotates, the first spur gear 251 and second spur gear 252 sequentially receive the rotational force to rotate at the same time.

The boss 270 is coupled to the plate 202, and the first through the third capillaries 212*a*', 212*b*', and 212*c*' are formed on the boss 270. The first through the third capillaries 212*a*', 212*b*', and 212*c*' may be inserted into the boss 270, and the boss 270 may be configured to accommodate the first through the third capillaries 212*a*', 212*b*', and 212*c*', and support the accommodated first through the third capillaries 212*a*', 212*b*', and 212*c*'. The outlets 212*a*, 212*b*, and 212*c* communicate with the first through the third capillaries 212*a*', 212*b*', and 212*c*', respectively.

The outlets 212*a*, 212*b*, and 212*c* are all illustrated in FIG. 6, but only one outlet and capillary are illustrated in FIG. 7 since all the configuration and layout of three-dimensional first through the third capillaries 212*a*', 212*b*', and 212*c*' cannot be shown in a two-dimensional cross-sectional view. The reference numeral 212 is assigned to the outlet and the reference numeral 212' is assigned to the capillary in FIG. 7.

The valve pad 220 is to implement various modes of the freezing cycle. The valve pad 220 is configured to selectively open and close the outlets 212*a*, 212*b*, and 212*c* by rotation. The valve pad 220 distributes refrigerant to the first through the third capillaries 212*a*', 212*b*', and 212*c*' through a selective opening and closing of the first through the third outlet 212*a*, 212*b*, and 212*c*.

The valve pad 220 is disposed between the second spur gear 252 and the boss 270. The valve pad 220 selectively opens and closes the outlets while rotating around the second shaft 260 by a rotational force transferred from the second spur gear 252.

The valve pad 220 may include a groove 226*a* and 226*b* at a portion facing the second spur gear 252. The second spur gear 252 may include a protrusion 252*a* and 252*b* inserted into the groove 226*a* and 226*b* of the valve pad 220 to be coupled to the valve pad 220. As the protrusion 252*a* and 252*b* of the second spur gear 252 is inserted into the groove 226*a* and 226*b* of the valve pad 220, the second spur gear 252 and the valve pad 220 may rotate at the same time.

An arrow of FIG. 7 denotes a flow of refrigerant. The refrigerant is introduced into an inside of the 4-way valve 200 through the inlet 211 of the 4-way valve 200. Accordingly, the refrigerant is filled into an inner space of the 4-way valve 200. As the valve pad 220 rotates, at least one of the outlets 212*a*, 212*b*, and 212*c* is open or all the outlets 212*a*, 212*b*, and 212*c* are closed. FIG. 7 illustrates that any one outlet 212 is open, wherein the refrigerant is discharged through the open outlet 212.

A mechanism of allowing the valve pad 220 to open and close the first through the third capillaries 212*a*', 212*b*', and 212*c*' is as follows. When a protrusion 222*a*, 222*b*, and 222*c* (refer to FIG. 8A) of the valve pad 220 is closely brought into contact with at least one of the outlets while rotating the valve pad 220, an outlet closely brought into contact with the protrusion portions 222*a*, 222*b*, and 222*c* (refer to FIG. 8A) is closed. In some implementations, an outlet 212 that does not face a protruded portion of the valve pad 220 is open. A gap may exist between the outlet 212 and the valve pad 220 that does not face the protrusion portion 222*a*, 222*b*, and 222*c* (refer to FIG. 8A) of the valve pad 220, and thus refrigerant may be discharged through the gap.

The valve pad 220 should be sufficiently brought into contact with to the boss 270 to open and close the outlets 212*a*, 212*b*, and 212*c*. A close contact with the valve pad 220 is carried out by the first leaf spring 281 and second leaf spring 282.

The first leaf spring 281 is disposed between the case 201 and the first spur gear 251 to support the first spur gear 251. The first leaf spring 281 is formed in a shape having a bridge at an edge of the disk. The bridge may form a predetermined angle with respect to the disk. The bridge is pressurized by an inner circumferential surface of the case 201, and accordingly, the disk pressurizes the rotor 230. The rotor 230 and first spur gear 251 are closely brought into contact with to a side of the plate 202 by the first leaf spring 281. It may be understood that the rotor 230 and first spur gear 251 is supported in the principle of being pressurized from both sides by the first leaf spring 281 and plate 202.

The second leaf spring 282 pressurizes the second spur gear 252 to allow the second spur gear 252 to be closely brought into contact with the valve pad 220. The second leaf spring 282 is also formed in a shape having a bridge at an edge of the disk. The bridge is bent toward the plate 202 and supported against the plate 202. The disk is pressurized by the first spur gear 251. There may be a structure in which a circumference of the disk is pressurized by an inner circumferential surface of the case 201. Furthermore, at least part 282*a* (refer to FIG. 6) of the disk is cut, and warped or bent to a side of the second spur gear 252. The part 282*a* pressurizes an upper portion of the second spur gear 252. Accordingly, the second spur gear 252 pressurizes the valve pad 220, and the valve pad 220 is closely brought into contact with the boss 270.

Referring to FIG. 6, the outlets 212*a*, 212*b*, and 212*c* are arranged according to a circumferential direction of the boss 270. The boss 270 is fixed, and the valve pad 220 is configured to rotate, and thus whether to open or close each of the outlets 212*a*, 212*b*, and 212*c* according to the shape and rotation angle of the valve pad 220. Hereinafter, the shape of the valve pad 220 will be first described, and subsequently, various modes according to the rotation angle of the valve pad 220 will be described.

Figure 8A:
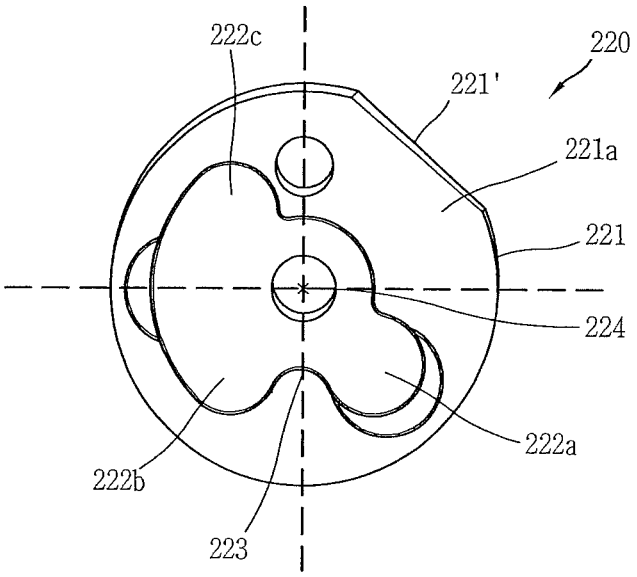
FIGS. 8A and 8B are conceptual views of an example valve pad of a 4-way valve.
Figure 8B:
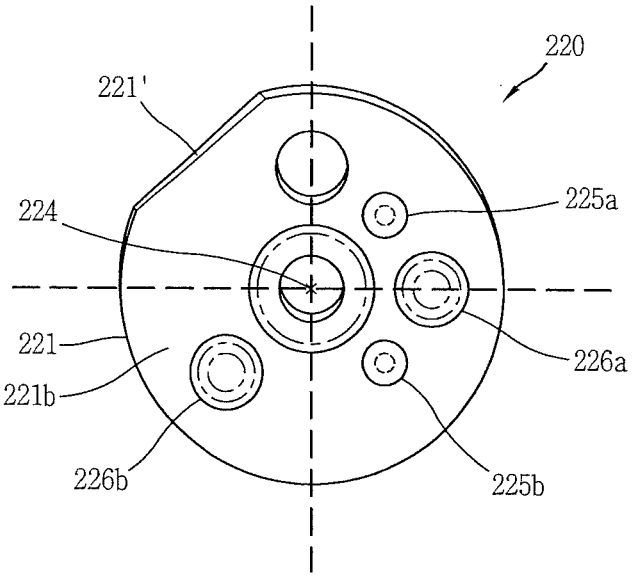

FIGS. 8A and 8B illustrate example valve pads 220.

The valve pad 220 selectively opens and closes the outlets 212*a*, 212*b*, and 212*c* (refer to FIG. 6) by rotation to distribute refrigerant to the outlets 212*a*, 212*b*, and 212*c* (refer to FIG. 6). Referring to FIG. 8A, the valve pad 220 may include a base portion 221, a protrusion portion 222*a*, 222*b*, and 222*c*, and a recess portion 223.

The base portion 221 is disposed to face the outlets 212*a*, 212*b*, and 212*c* (refer to FIG. 7). The base portion 221 may be formed in a substantially circular plate shape. The base portion 221 may include a first surface 221*a* and a second surface 221*b* facing opposite directions to each other. FIG. 8A is a view in which the first surface 221*a* is seen, and FIG. 8B is a view in which the second surface 221*b* is seen. When the valve pad 220 is disposed between the second spur gear 252 (refer to FIG. 7) and the boss 270 (refer to FIG. 7), the first surface 221*a* of the base portion 221 faces the outlets 212*a*, 212*b*, and 212*c* (refer to FIG. 6), and the second surface 221*b* faces the second spur gear 252 (refer to FIG. 7).

The base portion 221 may include a position setting portion 221' formed such that at least part of a circular edge thereof is cut to fix its position with respect to the counterpart. The position setting portion 221' is to set an initial position of the valve pad 220. When the base portion 221 is completely formed in a circular shape, a relative position to the second spur gear 252 may not accurately match with each other during the assembly of the 4-way valve 200. However, when part of the base portion 221 is cut to form the position setting portion 221', an initial position of the valve pad 220 may be accurately set based on the position setting portion 221', and a relative position of the second spur gear 252 to the valve pad 220 may also accurately match with each other.

The protrusion portion 222*a*, 222*b*, and 222*c* is protruded from the base portion 221 to block any one of the outlets 212*a*, 212*b*, and 212*c* (refer to FIG. 6) according to the rotation of the valve pad 220. More specifically, the protrusion portion 222*a*, 222*b*, and 222*c* is protruded from the first surface 221*a* of the base portion 221.

When the valve pad 220 rotates, the outlets 212*a*, 212*b*, and 212*c* (refer to FIG. 6) are selectively opened and closed. The outlets 212*a*, 212*b*, and 212*c* (refer to FIG. 6) define a selectively opened and closed state as a mode implemented by the rotation of the valve pad 220.

According to the present disclosure, a mode implemented by the rotation of the valve pad 220 may largely include a full closed mode, a first mode, a second mode, and a third mode. The modes are differentiated from each other, and each mode is determined according to a relative position of the outlets 212*a*, 212*b*, and 212*c* (refer to FIG. 6) to the protrusion portion 222*a*, 222*b*, and 222*c*. The valve pad 220 is configured to rotate, and the outlets 212*a*, 212*b*, and 212*c* (refer to FIG. 6) are fixed, and thus a relative position of the outlets 212*a*, 212*b*, and 212*c* (refer to FIG. 6) to the protrusion portion 222*a*, 222*b*, and 222*c* may vary according to the rotation angle of the valve pad 220.

Hereinafter, each of the modes will be described.

The full closed mode indicates a state in which the protrusion portion 222*a*, 222*b*, and 222*c* blocks all the outlets 212 according to the rotation of the valve pad 220. In the full closed mode, the first through the third outlet 212*a*, 212*b*, and 212*c* are all closed, and thus a flow of refrigerant is blocked at the 4-way valve 200. Accordingly, in the full closed mode, the refrigerant may not circulate through the first through the third capillaries 212*a*', 212*b*', and 212*c*' (refer to FIGS. 1 through 5).

The first mode indicates a state in which the protrusion portion 222*a*, 222*b*, and 222*c* blocks any two outlets of the first through the third outlets 212*a*, 212*b*, and 212*c* (refer to FIG. 6) (two outlets of 212*a*, 212*b*, and 212*c*). In the first mode, refrigerant is discharged only to one opened outlet (any one outlet of 212*a*, 212*b*, and 212*c*), and the refrigerant is not discharged to the remaining two outlets (the remaining two outlets excluding the any one outlet of 212*a*, 212*b*, and 212*c*).

The second mode indicates a state in which the protrusion portion 222*a*, 222*b*, and 222*c* blocks any one outlet of the outlets 212*a*, 212*b*, and 212*c* (refer to FIG. 6) (any one of 212*a*, 212*b*, and 212*c*). In the second mode, refrigerant is discharged to two opened outlets (the remaining two outlets excluding any one outlet of 212*a*, 212*b*, and 212*c*), and the refrigerant is not discharged to the remaining one outlet (any one outlet of 212*a*, 212*b*, and 212*c*).

The third mode indicates a state in which the protrusion portion 222*a*, 222*b*, and 222*c* does not block all the outlets 212*a*, 212*b*, and 212*c* (refer to FIG. 6). In the third mode, all the outlets 212*a*, 212*b*, and 212*c* (refer to FIG. 6) are open, and the refrigerant is discharged to all the outlets 212*a*, 212*b*, and 212*c* (refer to FIG. 6).

The protrusion portion 222*a*, 222*b*, and 222*c* may include a first through a third portion 222*a*, 222*b*, and 222*c* for blocking the outlets 212*a*, 212*b*, and 212*c*, respectively, in the full closed mode. In the full closed mode, the first portion 222*a* of the protrusion portion 222*a*, 222*b*, and 222*c* is disposed to correspond to the first outlet 212*a*, and the second portion 222*b* is disposed to correspond to the second outlet 212*b*, and the third portion 222*c* is disposed to correspond to the third outlet 212*c*. At least part of the protrusion portion 222*a*, 222*b*, and 222*c* may surround a circumference of the hole 224 through which the second shaft 260 (refer to FIG. 7) passes.

For the sake of convenience of understanding, the base portion 221 may be divided into four quadrants around the center thereof as an origin. FIGS. 8A and 8B illustrate a dotted horizontal axis line and a dotted vertical axis line along with the valve pad 220. The regions located along a counter-clockwise direction from an upper right region among four regions divided by dotted lines are sequentially a first through a fourth quadrant. The first through the third portion 222*a*, 222*b*, and 222*c* are sequentially formed along one rotational direction of the valve pad 220. The first through the third portion 222*a*, 222*b*, and 222*c* are disposed on different quadrants of the base portion 221.

The first outlet 212*a*, second outlet 212*b*, and third outlet 212*c* are disposed on different quadrants, respectively, to correspond to the first portion 222*a*, second portion 222*b*, and third portion 222*c* in the full closed mode. When the first outlet 212*a*, second outlet 212*b*, and third outlet 212*c* are disposed on different quadrants, it may further reduce a size of the 4-way valve 200 than that of a case where the first outlet 212*a*, second outlet 212*b*, and third outlet 212*c* are disposed on the same quadrant. Referring to FIG. 8A, a hole 224 through which the second shaft 260 passes may be the center of the base portion 221, and one rotational direction of the valve pad 220 indicates a clockwise direction. The first portion 222*a* is disposed on the fourth quadrant, and the second portion 222*b* is disposed on the third quadrant, and the third portion 222*c* is disposed on the second quadrant. In the full closed mode, the position of the outlets 212*a*, 212*b*, and 212*c* (refer to FIG. 6) may be derived from the position of the first through the third portion 222*a*, 222*b*, and 222*c*. The outlets 212*a*, 212*b*, and 212*c* are sequentially arranged along the rotational direction of the valve pad 220 similarly to the first through the third portion 222*a*, 222*b*, and 222*c*.

Contrary to that a recess portion 223 exists between the first portion 222*a* and the second portion 222*b*, the second portion 222*b* and third portion 222*c* are connected to each other in a protruded shape along a circumferential direction. Referring to FIG. 8*a*, the second portion 222*b* formed on the third quadrant is connected to the third portion 222*c* formed on the third quadrant, and they are connected to each other through a horizontal axis along a circumferential direction. A portion of connecting the second portion 222*b* to the third portion 222*c* by crossing a dotted horizontal axis line may be referred to as a connection portion.

As the valve pad 220 rotates, any one of the outlets 212*a*, 212*b*, and 212*c* (refer to FIG. 6) may be disposed between the second portion 222*b* and the third portion 222*c*, namely, at a position of the dotted horizontal axis line for dividing the third and the fourth quadrant. In this case, the second portion 222*b* and the third portion 222*c* are connected to each other in a protruded shape over a boundary of the quadrant along a circumferential direction, and thus an outlet (one of 212*a*, 212*b*, and 212*c*, refer to FIG. 6) located at the dotted horizontal axis line is closely brought into contact with a connection portion and closed. Such a result is different from a result shown due to the configuration in which the recess portion 223 is formed between the first portion 222*a* and the second portion 222*b*.

The recess portion 223 is formed between the first portion 222*a* and the second portion 222*b*. As the recess portion 223 is formed between the first portion 222*a* and the second portion 222*b*, an outlet (one of 212*a*, 212*b*, and 212*c*, refer to FIG. 6) located at the dotted vertical axis line for dividing the fourth and the third quadrant in any mode is open. For example, the first portion 222*a* and the first through the third outlet 212*a*, 212*b*, and 212*c* are disposed to correspond to each other in the full closed mode. However, when the recess portion 223 and the first outlet 212*a* (refer to FIG. 6) are disposed to correspond to each other as the valve pad 220 rotates, the first outlet 212*a* (refer to FIG. 6) is open. The any mode may be the second mode, and when switched from the full closed mode to the second mode, the first outlet 212*a* (refer to FIG. 6) disposed to correspond to the recess portion 223 may be open.

The valve pad 220 is not fixed but rotated, and thus the outlets 212*a*, 212*b*, and 212*c* (refer to FIG. 6) disposed to correspond to the first through the third portion 222*a*, 222*b*, and 222*c* is closed according to the rotation of the valve pad 220. Furthermore, the second portion 222*b* and the third portion 222*c* are connected to each other in a protruded state, and thus an outlet (any one of 212*a*, 212*b*, and 212*c*) disposed between the second portion 222*b* and the third portion 222*c* is also closed.

In some implementations, an outlet (212*a*, 212*b*, and 212*c*, refer to FIG. 6) disposed to correspond to the base portion 221 and recess portion 223 is open. The recess portion 223 is to distinguish it from the other base portion 221, and a mechanism for allowing the recess portion 223 to open the outlets 212*a*, 212*b*, and 212*c* is substantially the same as that of the base portion 221. In FIG. 8A, an outlet (212*a*, 212*b*, and 212*c*) disposed to correspond to the first quadrant of the base portion 221 is open.

Now, referring to FIG. 8B, FIG. 8B is a view in which the second surface 221*b* of the base portion 221 is seen. The second surface 221*b* is a portion coupled to the second spur gear 252. A groove 226*a* and 226*b* for being coupled to the second spur gear 252 is formed on the second surface 221*b*. The groove 226*a* and 226*b* corresponds to a protrusion 252*a* and 252*b* (refer to FIG. 6) of the second spur gear 252. During the assembly of the 4-way valve 200, the protrusion 252*a* and 252*b* is inserted into the groove 226*a* and 226*b* of the base portion 221.

The valve pad 220 may include a deformation prevention portion 225*a* and 225*b* for preventing the deformation of a shape. The deformation prevention portion 225*a* and 225*b* is formed to be recessed to a side of the first surface 221*a* from the second surface 221*b*. In particular, the deformation prevention portion 225*a* and 225*b* may be formed at a position corresponding to the protrusion portion 222*a*, 222*b*, and 222*c* to prevent a deformation due to a thickness of the protrusion portion 222*a*, 222*b*, and 222*c*. Comparing FIG. 8A with FIG. 8B, the deformation prevention portions 225*a* and 225*b* correspond to the second portion 222*b* and the third portion 222*c*, respectively.

The valve pad 220 may be formed by an injection molding. A diameter of the valve pad 220 is typically less than 1 cm, and when the protrusion portion 222*a*, 222*b*, and 222*c* in a complicated shape is formed on the valve pad 220 in a small size, a deformation of the shape may occur subsequent to the injection molding due to the thickness. When the shape of the valve pad 220 is deformed, it may be unable to perform the role of properly opening and closing the outlets 212*a*, 212*b*, and 212*c* (refer to FIG. 6), thereby causing an abnormal operation of the freezing cycle due to the leakage of refrigerant. When the deformation prevention portion 225*a* and 225*b* is formed at a position corresponding to the protrusion portion 222*a*, 222*b*, and 222*c*, it may be possible to prevent the deformation of the valve pad 220, and prevent an abnormal operation of the freezing cycle.

Figure 9:
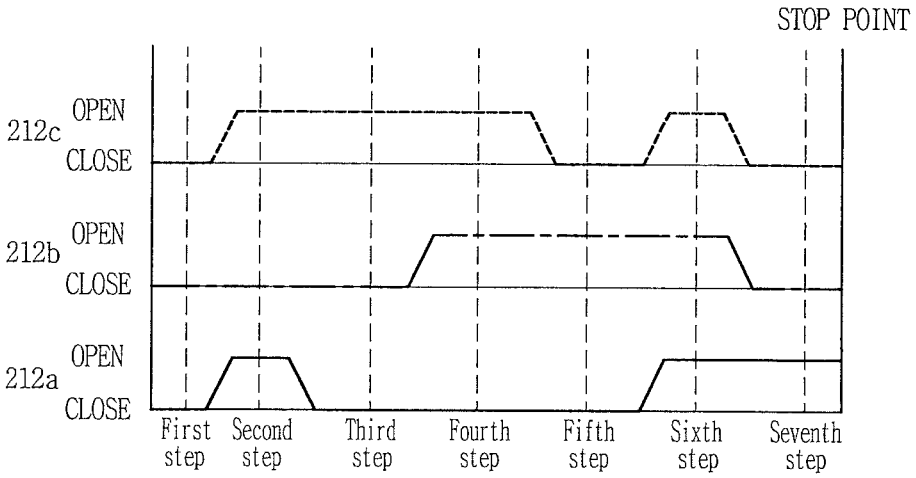
FIG. 9 is a chart for a mode implemented using an example 4-way valve.

FIG. 9 illustrates example modes implemented using a 4-way valve 200.

On the chart, the horizontal axis indicates a step of the stepping motor. The stepping motor rotates to an angle corresponding to a specific step whenever a pulse signal corresponding to the specific pulse is applied thereto. Furthermore, as described above, when the stepping motor rotates, the valve pad 220 (refer to FIGS. 8A and 8B) also rotates. A rotation angle of the valve pad 220 (refer to FIGS. 8A and 8B) corresponding to a unit step (1 step) of the stepping motor is determined by a step of a preset stop point. When 360 is divided by the steps of the stop points, a rotation angle of the valve pad 220 corresponding to the unit step is calculated.

For example, the steps of the stop points are set to 360 steps, an angle from the origin (0) to 360 steps corresponds to one revolution of the valve pad 220. Accordingly, an angle of 1° resulting from that 360 is divided by 360, that is, the steps of stop points, becomes a rotation angle of the valve pad 220 corresponding to a unit step. The valve pad 220 rotates by 1° when a pulse signal applied to the stepping motor corresponds to one step, and the valve pad 220 rotates by 10° when a pulse signal applied to the stepping motor corresponds to 10 steps.

Similarly, when the steps of the stop points are set to 200 steps, an angle from the origin (0) to 200 steps corresponds to one revolution of the valve pad 220 (refer to FIGS. 8A and 8B). Accordingly, an angle of 1.8° resulting from that 360 is divided by 200, that is, the steps of stop points, becomes a rotation angle of the valve pad 220 corresponding to a unit step. The valve pad 220 rotates by 1.8° when a pulse signal applied to the stepping motor corresponds to one step, and the valve pad 220 rotates by 18° when a pulse signal applied to the stepping motor corresponds to 10 steps.

Hereinafter, for the sake of convenience of explanation, it will be described a case where the steps of the stop points are set to 200 steps. There are total seven types of switching modes of the outlets 212*a*, 212*b*, and 212*c* (refer to FIG. 6) that can be implemented by the valve pad 220 (refer to FIGS. 8A and 8B), and thus it will be described such that the steps of the stepping motor corresponding to each mode are set to a first through a seventh step. The ordinal numbers of the first through the seventh step are to distinguish them from each other, but do not denote a specific step, and the first through the seventh step may be arbitrarily determined within a range between 0 step to 200 steps. For example, the first step, the second step, the third step, the fourth step, the fifth step, the sixth step and the seventh step may be determined to be 4 steps, 34 steps, 54 steps, 94 steps, 124 steps, 154 steps and 184 steps, respectively, but the present disclosure may not be necessarily limited to this.

On the chart, the vertical axis indicates a switching state of the outlets 212*a*, 212*b*, and 212*c* (refer to FIG. 6).

Referring to FIG. 9, all the outlets 212*a*, 212*b*, and 212*c* (refer to FIG. 6) are closed at the origin.

1. First Step

When a change is given to a stepping motor, and a pulse signal corresponding to a first step (for example, 4 steps) is applied to the stepping motor, the valve pad 220 (refer to FIGS. 8A and 8B) rotates by an angle (for example, 4×1.8°=7.2°) corresponding to the first step. Furthermore, a full closed mode in which the outlets 212*a*, 212*b*, and 212*c* are all closed by the rotation of the valve pad 220 is implemented.

2. Second Step

When a change is given to a stepping motor, and a pulse signal corresponding to a second step (for example, 34 steps) is applied to the stepping motor, the valve pad 220 rotates by an angle (for example, 34×1.8°=61.2°) corresponding to the second step. Furthermore, a second mode in which the second outlet 212*b* is closed and the first outlet 212*a* is open by the rotation of the valve pad 220 is implemented.

3. Third Step

When a change is given to a stepping motor, and a pulse signal corresponding to a third step (for example, 54 steps) is applied to the stepping motor, the valve pad 220 (refer to FIGS. 8A and 8B) rotates by an angle (for example, 54×1.8°=97.2°) corresponding to the third step. Furthermore, a first mode in which the first outlet 212*a* and second outlet 212*b* are closed and the third outlet 212*c* is open by the rotation of the valve pad 220 is implemented.

4. Fourth Step

When a change is given to a stepping motor, and a pulse signal corresponding to a fourth step (for example, 94 steps) is applied to the stepping motor, the valve pad 220 rotates by an angle (for example, 94×1.8°=169.2°) corresponding to the fourth step. Furthermore, a second mode in which the first outlet 212*a* is closed and the second outlet 212*b* and third outlet 212*c* are open by the rotation of the valve pad 220 is implemented.

5. Fifth Step

When a change is given to a stepping motor, and a pulse signal corresponding to a fifth step (for example, 124 steps) is applied to the stepping motor, the valve pad 220 rotates by an angle (for example, 124×1.8°=223.2°) corresponding to the fifth step. Furthermore, a first mode in which the first outlet 212*a* and third outlet 212*c* are closed and the second outlet 212*b* is open by the rotation of the valve pad 220 is implemented.

6. Sixth Step

When a change is given to a stepping motor, and a pulse signal corresponding to a sixth step (for example, 154 steps) is applied to the stepping motor, the valve pad 220 rotates by an angle (for example, 154×1.8°=277.2°) corresponding to the sixth step. Furthermore, a third mode in which the outlets 212*a*, 212*b*, and 212*c* are all open by the rotation of the valve pad 220 is implemented.

7. Seventh Step

When a change is given to a stepping motor, and a pulse signal corresponding to a seventh step (for example, 184 steps) is applied to the stepping motor, the valve pad 220 rotates by an angle (for example, 184×1.8°=331.2°) corresponding to the seventh step. Furthermore, a first mode in which the second outlet 212*b* and third outlet 212*c* are closed and the first outlet 212*a* is open by the rotation of the valve pad 220 is implemented.

The valve pad 220 selectively implements any one of a full closed mode, a first mode, a second mode and a third mode. FIG. 9 illustrates modes implemented during one revolution of the valve pad 220. Accordingly, the valve pad 220 implements two full closed modes, three first modes distinguished from one another, two second modes distinguished from each other, and one third mode during one revolution from the origin to the origin again.

The full closed mode indicates a state in which the protrusion portion 222*a*, 222*b*, and 222*c* (refer to FIGS. 8A and 8B) closes all the outlets 212*a*, 212*b*, and 212*c* (refer to FIG. 6) according to the rotation of the valve pad 220. In the full closed mode, the outlets 212*a*, 212*b*, and 212*c* are all closed, and thus a flow of the refrigerant is blocked at the 4-way valve 200. Accordingly, the refrigerant is not supplied to the first through the third capillaries 212*a*', 212*b*', and 212*c*'.

The first mode indicates a state in which the protrusion portion 222*a*, 222*b*, and 222*c* (refer to FIGS. 8A and 8B) blocks any two outlets (two outlets of 212*a*, 212*b*, and 212*c*) of the first through the third outlets 212*a*, 212*b*, and 212*c*. The remaining one outlet (the remaining one outlet excluding two outlets of 212*a*, 212*b*, and 212*c*) excluding two outlets (two outlets of 212*a*, 212*b*, and 212*c*) blocked by the protrusion portion 222*a*, 222*b*, and 222*c* is open.

Since the outlets 212*a*, 212*b*, and 212*c* are three, the first mode may be distinguished as three different first modes according to which one of the first through the third outlets 212*a*, 212*b*, and 212*c* is open and which one thereof is closed. For example, a first in which the first outlet 212*a* and second outlet 212*b* are closed and the third outlet 212*c* is open, a first in which the first outlet 212*a* and third outlet 212*c* are closed and the second outlet 212*b* is open, and a first mode in which the second outlet 212*b* and third outlet 212*c* are closed and the first outlet 212*a* is open are distinguished from one another.

For the sake of convenience of understanding, each first mode may be referred to as follows in a distinguished manner.

A mode in which the first outlet 212*a* and second outlet 212*b* are closed and the third outlet 212*c* is open is referred to as a first-1 mode. A mode in which the first outlet 212*a* and third outlet 212*c* are closed and the second outlet 212*b* is open is referred to as a first-2 mode. A mode in which the second outlet 212*b* and third outlet 212*c* are closed and the first outlet 212*a* is open is referred to as a first-3 mode. When it is merely referred to as a first mode, it will indicate all the first-1 mode, first-2 mode and first-3 mode. However, such a naming is merely for the sake of convenience of explanation, and not to limit the scope of the present disclosure.

In the first mode, refrigerant is discharged to only one open outlet (any one of 212*a*, 212*b*, and 212*c*), and the refrigerant is not discharged to the remaining two outlets (the remaining two outlets excluding any one of 212*a*, 212*b*, and 212*c*).

The second mode indicates a state in which the protrusion portion 222*a*, 222*b*, and 222*c* blocks any one outlets (any one of 212*a*, 212*b*, and 212*c*) of the first through the third outlets 212*a*, 212*b*, and 212*c*. The remaining two outlets (the remaining two outlets excluding any one of 212*a*, 212*b*, and 212*c*) excluding one outlet (any one of 212*a*, 212*b*, and 212*c*) closed by the protrusion portion 222*a*, 222*b*, and 222*c* are open.

Since the outlets 212*a*, 212*b*, and 212*c* are three, the second mode may be distinguished as three different second modes according to which one of the first through the third outlets 212*a*, 212*b*, and 212*c* is open and which one thereof is closed. For example, a second mode in which the first outlet 212*a* is closed and the second outlet 212*b* and third outlet 212*c* are open, a second mode in which the second outlet 212*b* is closed and the first outlet 212*a* and third outlet 212*c* are open, and a second mode in which the third outlet 212*c* is closed and the first outlet 212*a* and second outlet 212*b* are open are distinguished from one another.

Here, also, for the sake of convenience of understanding, each second mode may be referred to as follows in a distinguished manner.

A mode in which the first outlet 212*a* is closed and the second outlet 212*b* and third outlet 212*c* are open is referred to as a second-1 mode. A mode in which the second outlet 212*b* is closed and the first outlet 212*a* and third outlet 212*c* are open is referred to as a second-2 mode. A mode in which the third outlet 212*c* is closed and the first outlet 212*a* and second outlet 212*b* are open is referred to as a second-3 mode. When it is merely referred to as a second mode, it will indicate all the second-1 mode, second-2 mode and second-3 mode. However, such a naming is merely for the sake of convenience of explanation, and not to limit the scope of the present disclosure.

In the second mode, refrigerant is discharged to two open outlets (two outlets of 212*a*, 212*b*, and 212*c*), and the refrigerant is not discharged to the remaining one outlet (the remaining one outlet of 212*a*, 212*b*, and 212*c*).

The third mode indicates a state in which the protrusion portion 222*a*, 222*b*, and 222*c* does not block all the first through the third outlets 212*a*, 212*b*, and 212*c*. Since all the outlets 212*a*, 212*b*, and 212*c* are open in the third mode, refrigerant is discharged to all the outlets 212*a*, 212*b*, and 212*c*. Contrary to the first mode and the second mode, there do not exist modes distinguished from one another in the third mode, and it is similar to the full closed mode. For instance, a number of cases where the outlets 212*a*, 212*b*, and 212*c* are all closed or all open is one.

Referring to FIG. 9, the valve pad 220 sequentially implements a full closed mode, any one second mode, any one first mode, another second mode, another first mode, a third mode, still another first mode, and a full closed mode during one revolution from the origin to the origin again.

More specifically, the valve pad 220 sequentially implements a full closed mode, a second-2 mode, a first-1 mode, a second-1 mode, a third mode, and a first-3 mode during one revolution. The full closed modes at the origin when the valve pad 220 starts the rotation and ends the rotation are similar to each other, and thus the valve pad 220 may total seven different modes.

Each mode implemented by the valve pad 220 may not be sequentially implemented, and modes required for the freezing cycle may be selectively implemented. However, for the sake of convenience of explanation, hereinafter, the operation of the freezing cycle in each mode will be described. The description which will be described below is summarized in Table 1.

TABLE 1

| Step | First outlet | Second outlet | Third outlet | Description |
|---|---|---|---|---|
| First step | Closed | Closed | Closed | The temperatures of the refrigerating chamber and freezing chamber are satisfied |
| Second step | Open | Closed | Open | The operation (initial activation) of the refrigerating chamber evaporator and freezing chamber evaporator |
| Third step | Closed | Closed | Open | The operation of the refrigerating chamber evaporator |
| Fourth step | Closed | Open | Open | The operation of the refrigerating chamber evaporator and freezing chamber evaporator |

TABLE 1-continued

| Step | First outlet | Second outlet | Third outlet | Description |
|---|---|---|---|---|
| Fifth step | Closed | Open | Closed | The operation of the refrigerating chamber evaporator (power consumption reduction operation) |
| Sixth step | Open | Open | Open | The operation of the refrigerating chamber evaporator and freezing chamber evaporator |
| Seventh step | Open | Closed | Closed | The operation of the freezing chamber evaporator (fast load response operation) |

The first through the third outlets 212*a*, 212*b*, and 212*c* (refer to FIG. 6) are all closed in the full closed mode (first step), and thus refrigerant does not flow through the first through the third capillaries 212*a*', 212*b*', and 212*c*' (refer to FIGS. 1 through 5).

The first outlet 212*a* and third outlet 212*c* are open and the second outlet 212*b* is closed in the second-2 mode (second step), and thus refrigerant flows through the first capillary 212*a*' and third capillary 212*c*', and the refrigerant does not flow through the second capillary 212*b*'. In the second-2 mode, the refrigerating chamber evaporator 181 (refer to FIGS. 1 through 4) that has received refrigerant through the third capillary 212*c*' and the freezing chamber evaporator 182 (refer to FIGS. 1 through 4) that has received refrigerant through the first capillary 212*a*' may be operated to reduce the temperatures of the refrigerating chamber 112 (refer to FIGS. 1 through 3) and freezing chamber 113 (refer to FIGS. 1 through 3). In case that both the temperatures of the refrigerating chamber 112 and freezing chamber 113 are above initial reference temperatures when initial power is applied to the refrigerator 100, the refrigerator 100 may be operated in the second-2 mode.

The third outlet 212*c* is open and the first outlet 212*a* and second outlet 212*b* are closed in the first-1 mode (third step), and thus refrigerant flows through the third capillary 212*c*' and refrigerant does not flow through the first capillary 212*a*' and second capillary 212*b*'. In the first-1 mode, the refrigerating chamber evaporator 181 that has received refrigerant through the third capillary 212*c*' may be operated to reduce the temperature of the refrigerating chamber. When the temperature of the refrigerating chamber 112 is above a set temperature, the refrigerator 100 is operated in the first-1 mode.

The second outlet 212*b* and third outlet 212*c* are open and the first outlet 212*a* is closed in the second-1 mode (fourth step), and thus refrigerant flows through the second capillary 212*b*' and third capillary 212*c*' and refrigerant does not flow through the first capillary 212*a*'. In the second-1 mode, the refrigerating chamber evaporator 181 that has received refrigerant through the third capillary 212*c*' and the freezing chamber evaporator 182 that has received refrigerant through the second capillary 212*b*' may be operated to reduce the temperatures of the refrigerating chamber 112 and freezing chamber 113.

The second outlet 212*b* is open and the first outlet 212*a* and third outlet 212*c* are closed in the first-2 mode (fifth step), and thus refrigerant flows through the second capillary 212*b*' and refrigerant does not flow through the first capillary 212*a*' and third capillary 212*c*'. In the first-1 mode, the freezing chamber evaporator 182 that has received refrigerant through the second capillary 212*b*' may be operated to reduce the temperature of the freezing chamber 113. In the first-2 mode, refrigerant flows through the second capillary 212*b*' having a smaller inner diameter than that of the first capillary 212*a*', thereby allowing the refrigerator 100 to obtain a power consumption reduction effect through the operation of the first-2 mode.

The first through the third outlets 212*a*, 212*b*, and 212*c* are open in the third mode (sixth step), and thus refrigerant flows through the first through the third capillaries 212*a*', 212*b*', and 212*c*'. In the third mode, the refrigerating chamber evaporator 181 that has received refrigerant through the third capillary 212*c*' and the freezing chamber evaporator 182 that has received refrigerant through the first and the second capillary 212*a*' and 212*b*' may be operated to reduce the temperatures of the refrigerating chamber 112 and freezing chamber 113.

The first outlet 212*a* is open and the second outlet 212*b* and third outlet 212*c* are closed in the first-3 mode (seventh step), and thus refrigerant flows through the first capillary 212*a*' and refrigerant does not flow through the second capillary 212*b*' and third capillary 212*c*'. In the first-3 mode, the freezing chamber evaporator 182 that has received refrigerant through the first capillary 212*a*' may be operated to reduce the temperature of the freezing chamber 113. In the first-3 mode, refrigerant flows through the first capillary 212*a*' having a larger inner diameter than that of the first capillary second capillary 212*b*', thereby allowing the refrigerator 100 to obtain effects such as a fast load response, a passage blockage prevention, and a dew condensation prevention through the operation of the first-3 mode.

FIGS. 10A through 10H illustrate example valve pads 220.

FIGS. 10A through 10H are views in which the 4-way valve 200 illustrated in FIG. 5 is seen from the bottom to the top. However, it is illustrated that unnecessary constituent elements (e.g., the plate 202, etc.) are excluded for clear understanding of a switching state of the first through the third outlets 212*a*, 212*b*, and 212*c* and a rotation angle of the valve pad 220.

In FIGS. 10A through 10H, the first through the third capillaries 212*a*', 212*b*', and 212*c*' and the first through the third outlets 212*a*, 212*b*, and 212*c* are fixed in common, and only the valve pad 220 rotates. The first through the third outlets 212*a*, 212*b*, and 212*c* correspond to the first through the third capillaries 212*a*', 212*b*', and 212*c*', respectively. The first through the third outlets 212*a*, 212*b*, and 212*c* are sequentially arranged along one rotation direction of the valve pad 220.

As illustrated in the drawing, the first through the third outlets 212*a*, 212*b*, and 212*c* are arranged in a clockwise direction. An implemented mode varies according to a rotation angle of the valve pad 220, and the valve pad 220 rotates in a counter-clockwise direction when drawings in FIGS. 10A trough 10H are sequentially seen. The drawings in FIGS. 10A trough 10H correspond to a chart illustrated in FIG. 9, and thus may be more easily understood with reference to FIG. 9.

Figure 10A:
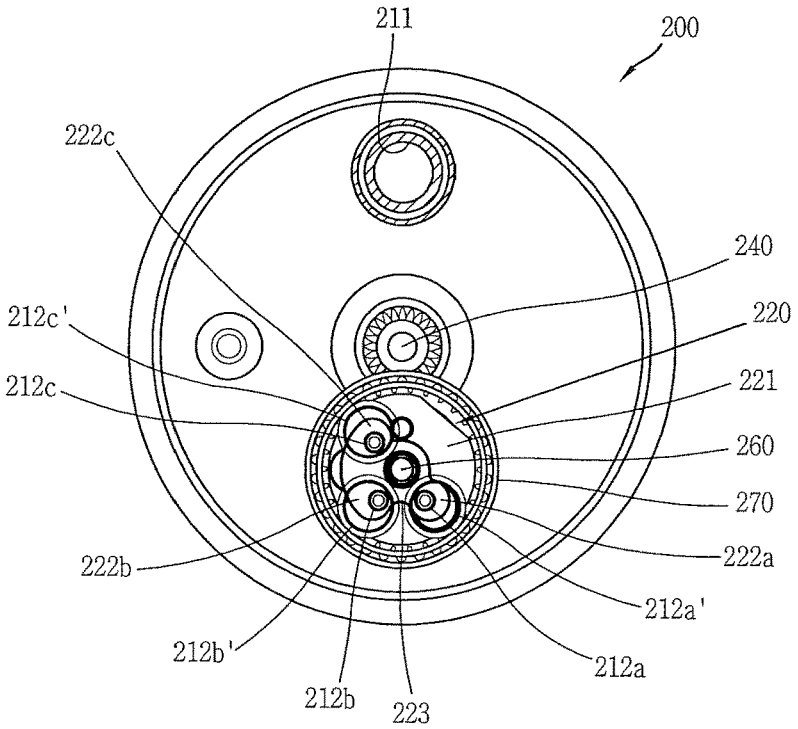
FIGS. 10A through 10H are conceptual views of an example valve pad.

First, FIG. 10A illustrates a state at the origin. The first through the third portion 222*c* at the origin are disposed to correspond to the first through the third outlets 212*a*, 212*b*, and 212*c*, respectively. Accordingly, all the first through the third outlets 212*a*, 212*b*, and 212*c* are closed at the origin.

Figure 10B:
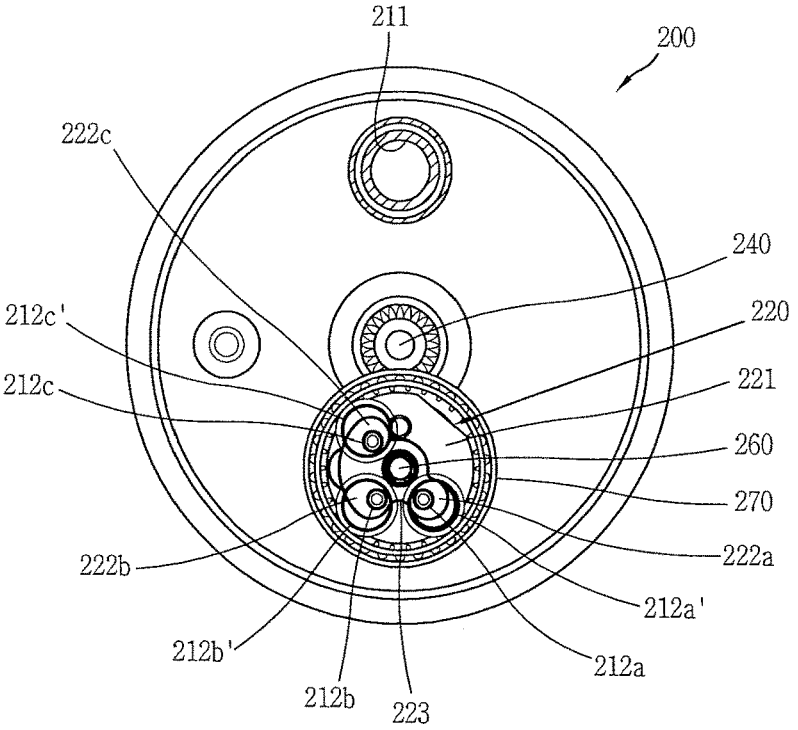

Next, FIG. 10B illustrates a state subsequent to the rotation of the valve pad 220 as a pulse signal corresponding to a first step is applied to the stepping motor. Comparing FIG. 10B with FIG. 10A, the valve pad 220 rotates a rotation angle corresponding to the first step along a clockwise direction from the origin. The first through the third portion 222*a*, 222*b*, and 222*c* are disposed to correspond to the first through the third outlets 212*a*, 212*b*, and 212*c*. In the first step, a full closed mode in which all the first through the third outlets 212*a*, 212*b*, and 212*c* are closed is implemented.

Figure 10C:
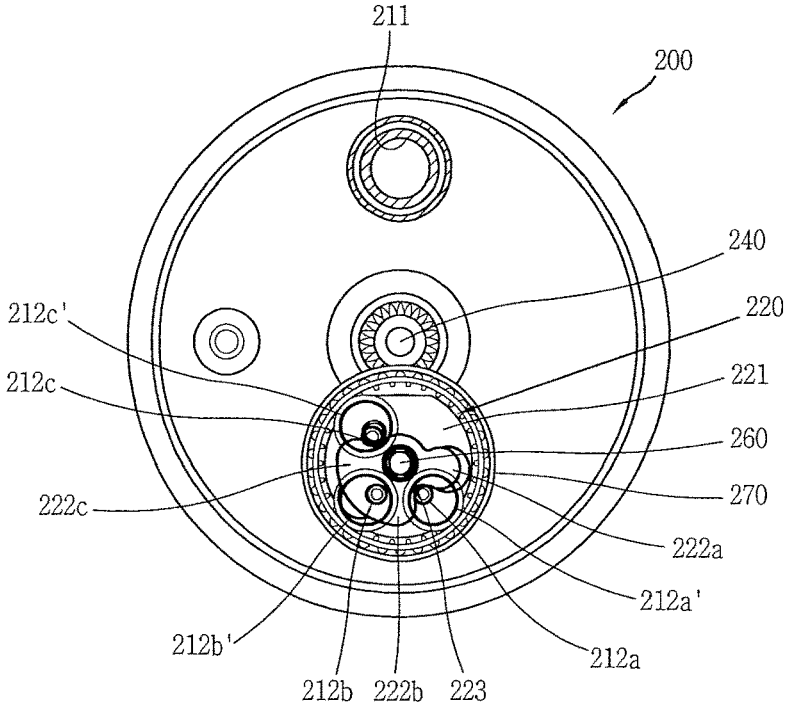

FIG. 10C illustrates a state subsequent to the rotation of the valve pad 220 as a pulse signal corresponding to a second step is applied to the stepping motor. Comparing FIG. 10C with FIG. 10B, the valve pad 220 rotates a rotation angle corresponding to the second step along a clockwise direction from the first step. The first outlet 212*a* is disposed and open to correspond to the recess portion 223. The second outlet 212*b* is disposed and closed between the second portion 222*b* and the third portion 222*c*. It is because the second portion 222*b* and third portion 222*c* are connected to each other in a protruding state. The third outlet 212*c* is disposed and open to correspond to the base portion 221. Since the second outlet 212*b* is closed and the first outlet 212*a* and third outlet 212*c* are open, a second mode is implemented, and more particularly, a second-2 mode is implemented in the second step.

Figure 10D:
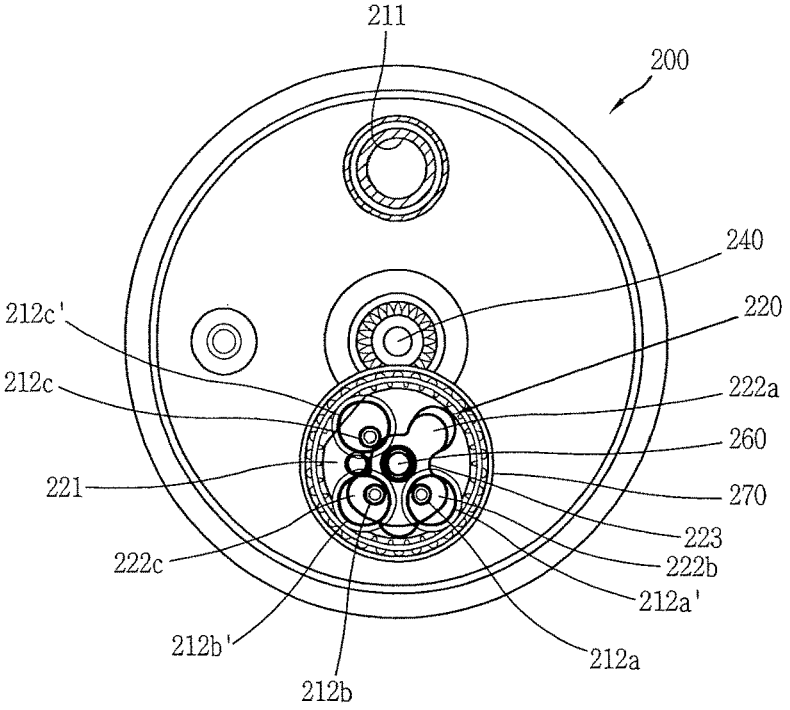

FIG. 10D is a state subsequent to the rotation of the valve pad 220 as a pulse signal corresponding to a third step is applied to the stepping motor. Comparing FIG. 10D with FIG. 10C, the valve pad 220 rotates a rotation angle corresponding to the third step along a clockwise direction from the second step. The first outlet 212*a* is disposed and closed to correspond to the second portion 222*b*. The second outlet 212*b* is disposed and closed to correspond to the third portion 222*c*. The third outlet 212*c* is disposed and open to correspond to the base portion 221. Since the first outlet 212*a* and second outlet 212*b* are closed and the third outlet 212*c* is open, a first mode is implemented, and more particularly, a first-1 mode is implemented in the third step.

Figure 10E:
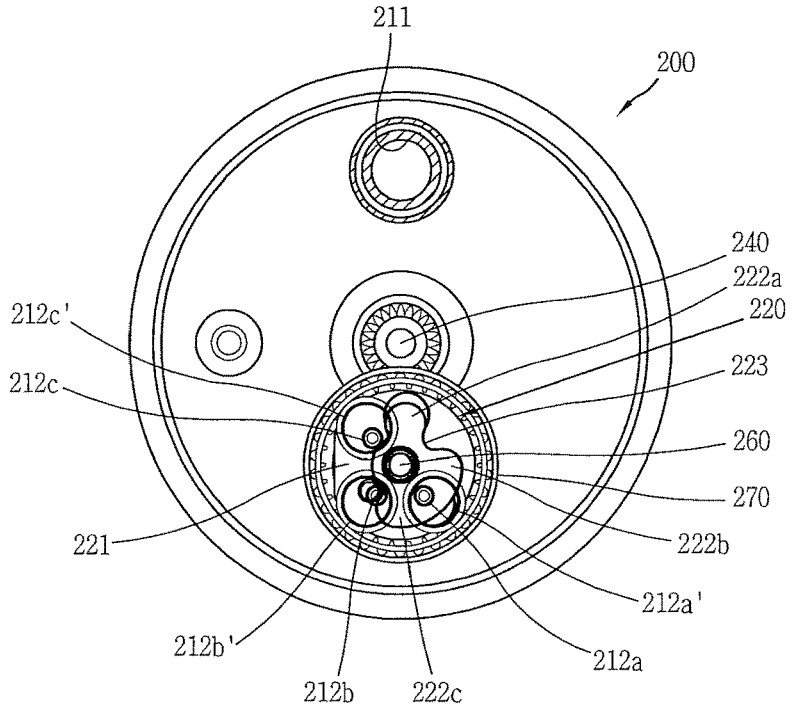

FIG. 10E illustrates a state subsequent to the rotation of the valve pad 220 as a pulse signal corresponding to a fourth step is applied to the stepping motor. Comparing FIG. 10E with FIG. 10D, the valve pad 220 rotates a rotation angle corresponding to the fourth step along a clockwise direction from the third step. The first outlet 212*a* is disposed and closed between the second portion 222*b* and the third portion 222*c*. It is because the second portion 222*b* and third portion 222*c* are connected to each other in a protruding state. The second outlet 212*b* and third outlet 212*c* are disposed and open to correspond to the base portion 221. Since the first outlet 212*a* is closed and the second outlet 212*b* and third outlet 212*c* are open, a second mode is implemented, and more particularly, a second-1 mode is implemented in the second step.

Figure 10F:
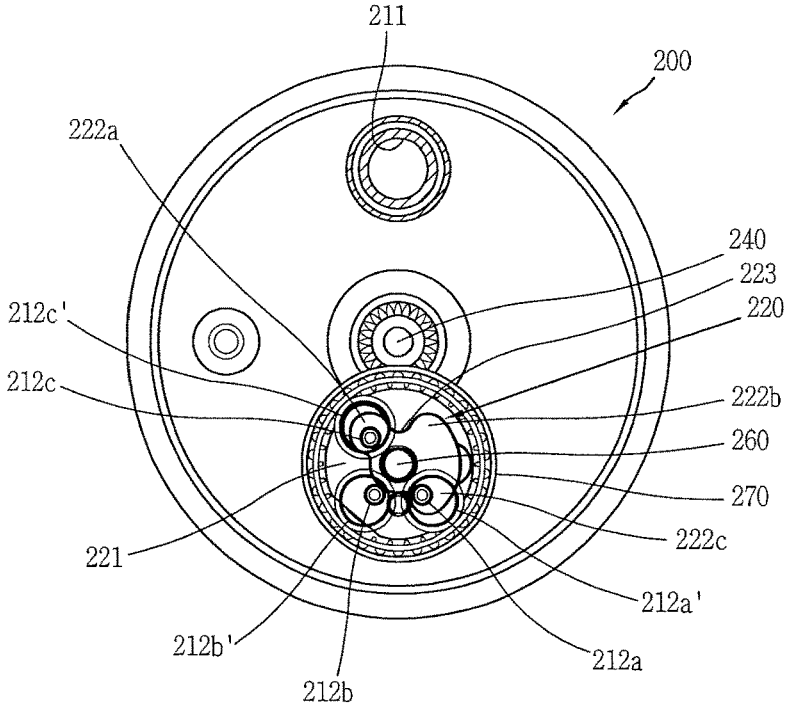

FIG. 10F is a state subsequent to the rotation of the valve pad 220 as a pulse signal corresponding to a fifth step is applied to the stepping motor. Comparing FIG. 10F with FIG. 10E, the valve pad 220 rotates a rotation angle corresponding to the fifth step along a clockwise direction from the fourth step. The first outlet 212*a* is disposed and closed to correspond to the third portion 222*c*. The second outlet 212*b* is disposed and open to correspond to the recess portion 223. The third outlet 212*c* is disposed and closed to correspond to the first portion 222*a*. Since the first outlet 212*a* and third outlet 212*c* are closed and the second outlet 212*b* is open, a first mode is implemented, and more particularly, a first-2 mode is implemented in the fifth step.

Figure 10G:
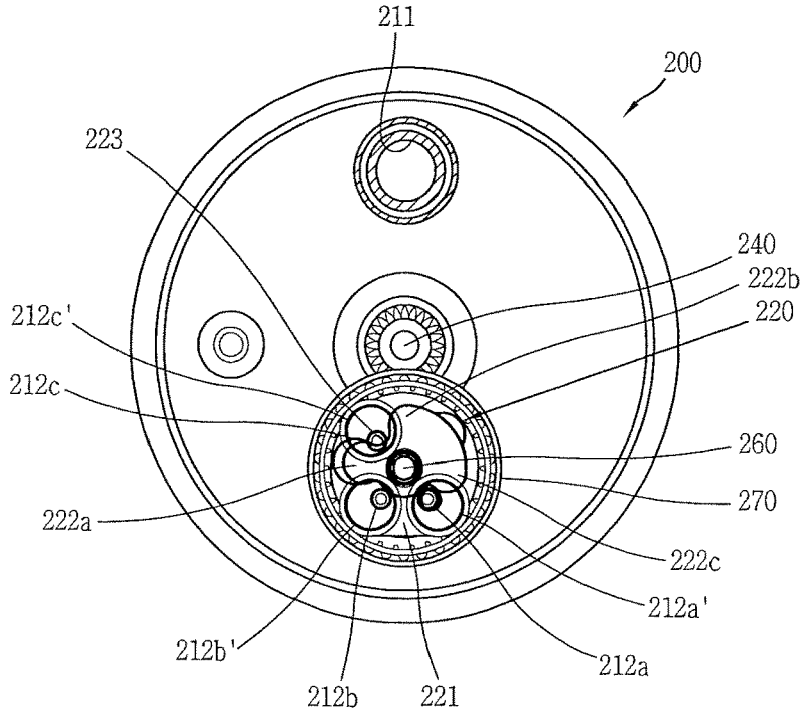

FIG. 10G is a state subsequent to the rotation of the valve pad 220 as a pulse signal corresponding to a sixth step is applied to the stepping motor. Comparing FIG. 10G with FIG. 10F, the valve pad 220 rotates a rotation angle corresponding to the sixth step along a clockwise direction from the fifth step. The first outlet 212*a* and second outlet 212*b* are disposed and open to correspond to the base portion 221. The third outlet 212*c* is disposed and open to correspond to the recess portion 223. Since the first through the third outlets 212*a*, 212*b*, and 212*c* are all open, a third mode is implemented in the sixth step.

Figure 10H:
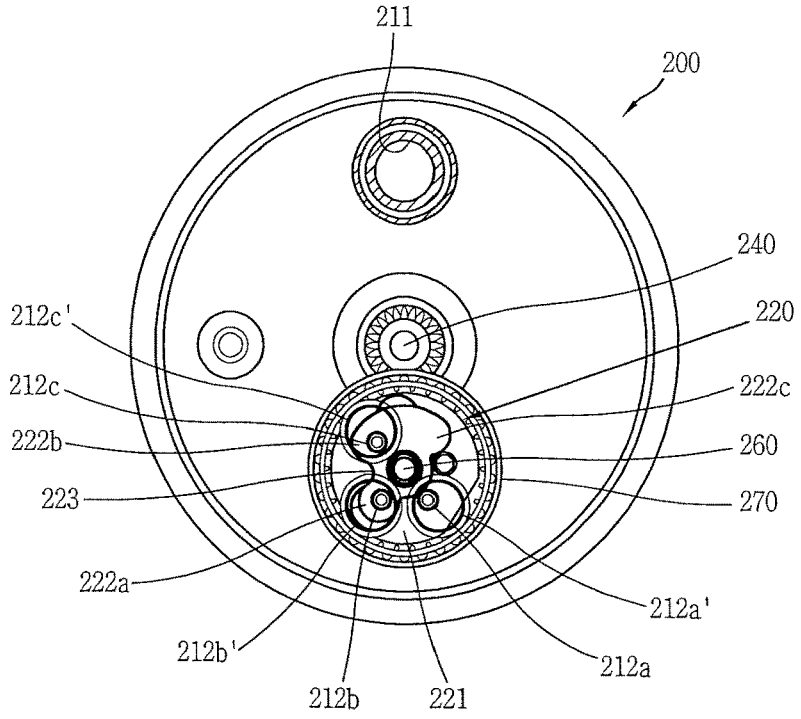

FIG. 10H is a state subsequent to the rotation of the valve pad 220 as a pulse signal corresponding to a seventh step is applied to the stepping motor. Comparing FIG. 10H with FIG. 10G, the valve pad 220 rotates a rotation angle corresponding to the seventh step along a clockwise direction from the sixth step. The first outlet 212*a* is disposed and open to correspond to the base portion 221. The second outlet 212*b* is disposed and closed to correspond to the first portion 222*a*. The third outlet 212*c* is disposed and closed to correspond to the second portion 222*b*. Since the second outlet 212*b* and third outlet 212*c* are closed and the first outlet 212*a* is open, a first mode is implemented, and more particularly, a first-3 mode is implemented in the seventh step.

In the above, the configuration of the refrigerator 100 having one compressor 160, two evaporators 181 and 182 and the 4-way valve 200 has been described. Hereinafter, an operation method of the refrigerator will be described. Reference numerals for each constituent element may refer to FIGS. 1 through 10H.

Figure 11:
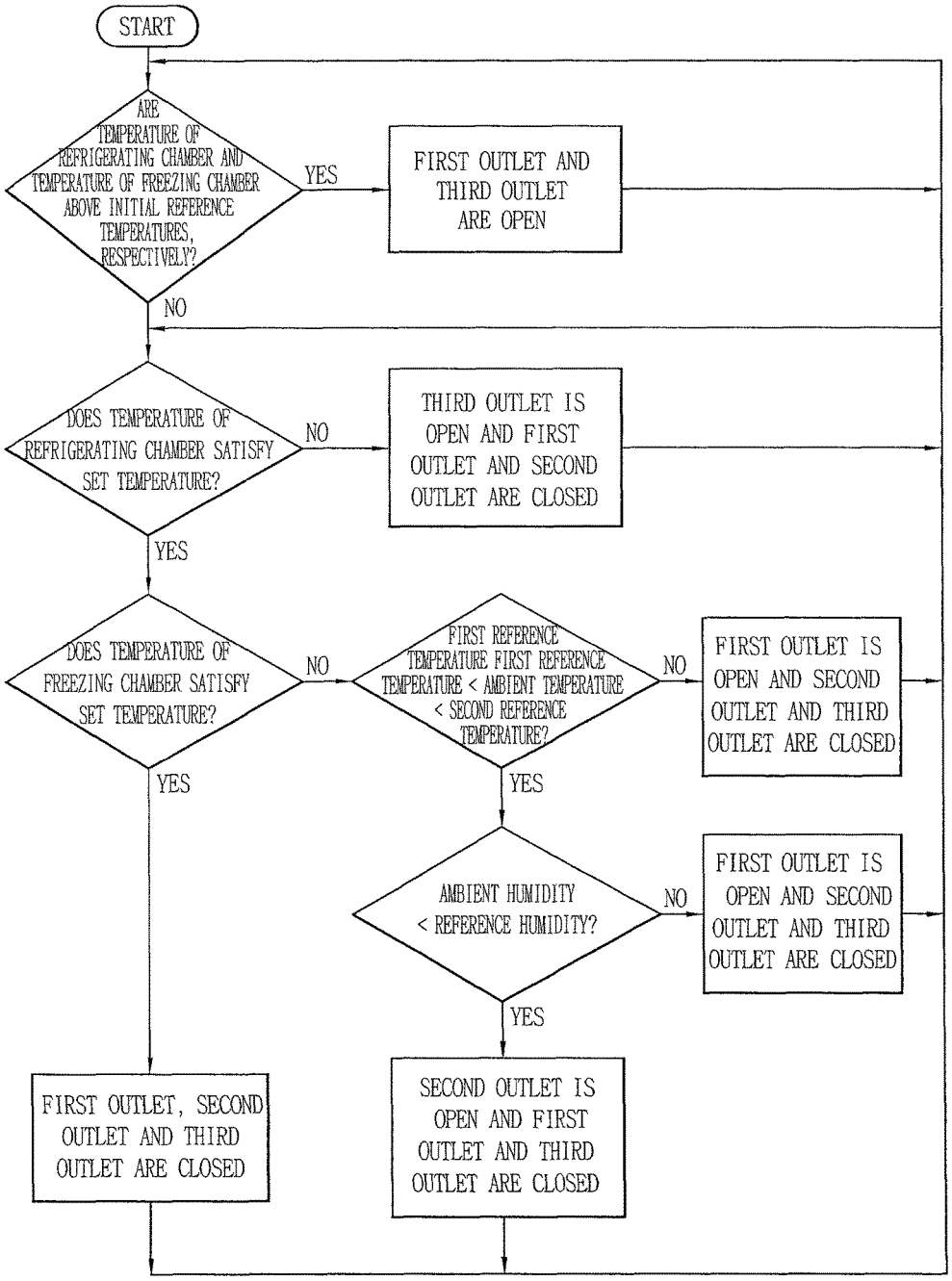
FIG. 11 is a flow chart of an example operation method of a refrigerator.

FIG. 11 illustrates an example operation method of a refrigerator 100.

A temperature of the refrigerating chamber 112, a temperature of the freezing chamber 113, an ambient temperature and ambient humidity are measured by the foregoing sensing unit. Furthermore, the operation which will be described below may be controlled by the controller (micom). The controller compares a temperature measured by the sensing unit with a set temperature or reference temperature and compares a humidity measured by the sensing unit with a reference humidity to control the operation of the 4-way valve.

First, the controller determines whether or not the temperatures of the refrigerating chamber 112 and freezing chamber 113 are above initial reference temperatures, respectively. The temperature of the refrigerating chamber 112 and the temperature of the freezing chamber 113 are initial reference temperatures (YES), the first outlet 212*a* and third outlet 212*c* are open by the operation of the 4-way valve.

An initial reference temperature is a temperature of preparing for a case where the temperature of the refrigerating chamber and the temperature of the freezing chamber are above preset references at the same time when initial power is applied to the refrigerator. The initial reference temperature may be set to a higher temperature than that of the refrigerating chamber 112 and that of the freezing chamber 113. The initial reference temperature may be set to the refrigerating chamber 112 and freezing chamber 113, respectively.

When initial power is supplied in a state that the refrigerator 100 completely stops, the temperature of the refrigerating chamber 112 and the temperature of the freezing chamber 113 are measured at an ambient temperature, and thus higher than the initial reference temperature. When the first outlet 212*a* and third outlet 212*c* are open by the operation of the 4-way valve 200, refrigerant flows into the first capillary 212*a*' and third capillary 212*c*'. The refrigerating chamber evaporator 181 that has received refrigerant through the first capillary 212*a*' and the freezing chamber evaporator 182 that has received refrigerant through the third capillary 212*c*' are operated at the same time. It may be possible to reduce the temperatures of the refrigerating chamber 112 and freezing chamber 113 by the operation of the refrigerating chamber evaporator 181 and freezing chamber evaporator 182.

A case where the temperature of the refrigerating chamber 112 and the temperature of the freezing chamber 113 are above initial reference temperatures is a specific case where initial power is supplied to the refrigerator 100, and thus an operation for determining whether or not temperature of the refrigerating chamber 112 and the temperature of the freezing chamber 113 are above initial reference temperatures, respectively, may be omitted subsequent to the completion of one revolution.

When the temperature of the refrigerating chamber 112 and the temperature of the freezing chamber 113 are below initial reference temperatures (NO), the controller determines whether or not the temperature of the refrigerating chamber 112 satisfies a set temperature of the refrigerating chamber 112.

In case where the temperature of the refrigerating chamber 112 does not satisfy a set temperature of the refrigerating chamber 112, the third outlet 212*c* is open and the first outlet 212*a* and second outlet 212*b* are closed by the operation of the 4-way valve 200. As the third outlet 212*c* is open, refrigerant flows into the refrigerating chamber evaporator 181 through the third capillary 212*c*'. When the refrigerating chamber evaporator 181 is operated, it may be possible to reduce the temperature of the refrigerating chamber 112 below a set temperature.

When the temperature of the refrigerating chamber 112 satisfies a set temperature of the refrigerating chamber 112 (YES), the controller determines whether or not the temperature of the freezing chamber 113 satisfies a set temperature of the freezing chamber 113.

When the temperature of the freezing chamber 113 satisfies a set temperature of the freezing chamber 113 (YES), the first through the third outlets 212*a*, 212*b*, and 212*c* are closed, and the operation of the compressor 160 stops.

When the temperature of the freezing chamber 113 does not satisfy a set temperature of the freezing chamber 113 (NO), an operation of enhancing the power consumption of the refrigerator 100, an operation of quickly responding to a load, an operation of suppressing passage blockage, an operation of preventing dew condensation, and the like are selected.

First, the controller determines whether or not an ambient temperature is higher than a first reference temperature and lower than a second reference temperature.

When an ambient temperature is relatively low as in winter, a passage blockage phenomenon may occur on a capillary having a small inner diameter. When the inner diameter of the capillary decreases, the possibility of passage blockage increases. The first reference temperature is a reference of an ambient temperature with a high possibility in which passage blockage occurs. The first reference temperature may be set to 18° C., for example. When an ambient temperature is lower than the first reference temperature (NO), passage blockage may occur, and thus a passage blockage suppression operation in which refrigerant flows into the first capillary 212*a*' having a relatively large inner diameter is selected to suppress the blockage of a passage. When the first outlet 212*a* is open and the second outlet 212*b* and third outlet 212*c* are closed by the operation of the 4-way valve 200, refrigerant flows into the freezing chamber evaporator 182 through the first capillary 212*a*'. When the freezing chamber evaporator 182 is operated, the temperature of the freezing chamber 113 may be reduced below a set temperature. Furthermore, as refrigerant flows into the third capillary 212*c*', it may be possible to prevent passage blockage.

When an ambient temperature is relatively high as in summer, the temperature of the freezing chamber 113 increases, and thus a fast load response operation is selected. The second reference temperature is a reference of an ambient temperature requiring for a fast load response The second reference temperature may be set to 27° C., for example. When an ambient temperature higher than the second reference temperature (NO), a fast load response operation in which refrigerant flows into the first capillary 212*a*' having a relatively large inner diameter is selected to perform a fast load response operation. When the first outlet 212*a* is open and the second outlet 212*b* and third outlet 212*c* are closed by the operation of the 4-way valve 200, refrigerant flows into the freezing chamber evaporator 182 through the first capillary 212*a*'. When the freezing chamber evaporator 182 is operated, the temperature of the freezing chamber 113 may be quickly reduced below a set temperature.

When an ambient temperature is higher than a first reference temperature and lower than a second reference temperature (YES), the controller compares an ambient humidity with a reference humidity to determine whether or not the ambient humidity is lower than the reference humidity. When the ambient humidity is too high, dew condensation may occur on a front portion of the refrigerator body 110, thereby preventing dew from being condensed when a larger flow rate of refrigerant flows into the hot line 211'. The reference humidity is a reference of an ambient humidity at which dew condensation easily occurs. The reference humidity may be set to 80%, for example. When an ambient temperature is higher than the reference humidity (NO), a dew condensation prevention operation is selected to supply sufficient refrigerant to the hot line 211'. When the first outlet 212*a* is open and the second outlet 212*b* and third outlet 212*c* are closed by the operation of the 4-way valve 200, refrigerant flows into the freezing chamber evaporator 182 through the first capillary 212*a*'. When the freezing chamber evaporator 182 is operated, the temperature of the freezing chamber 113 may be reduced below a set temperature. Furthermore, as refrigerant flows into the first capillary 212*a*', a flow rate of refrigerant flowing through the hot line 211' may increase to prevent the condensation of dew.

When an ambient temperature is between the first reference temperature and the second reference temperature (YES), and an ambient humidity is lower than the reference humidity (YES), a power consumption enhancement operation is selected. The second outlet 212*b* is open, and the first outlet 212*a* and third outlet 212*c* are closed by the operation of the 4-way valve. The temperature of the freezing chamber 113 may be reduced by the operation of the freezing chamber evaporator 182 that has received refrigerant through the second capillary 212*b*'. Furthermore, the second capillary 212*b*' may have a smaller inner diameter than that of the first outlet 212*a*, thereby allowing the power consumption enhancement operation to obtain a power consumption enhancement effect through a flow rate reduction of refrigerant circulating through the freezing cycle.

When the refrigerator 100 according to the present disclosure and an operation method thereof are applied through the foregoing operations, it may be possible to selectively implement a power consumption reduction operation, a fast load response operation, a passage blockage prevention operation, a dew condensation prevention operation, and the like of the refrigerator according to the temperature and humidity.

According to the present disclosure having the foregoing configuration, a 4-way valve may selectively supply refrigerant to three capillaries connected to the 4-way valve. Selectively supplying refrigerant denotes supplying refrigerant to any one capillary, any two capillaries, or three capillaries.

Furthermore, as the 4-way valve is employed, the present disclosure may connect two capillaries to the freezing cycle to dualize a capillary. The dualized capillary have a different inner diameter, and thus the present disclosure may determine a flow rate of refrigerant circulating the freezing cycle according to which capillary is selected as a refrigerant flow passage. Furthermore, the controller compares an ambient humidity with a reference humidity to determine whether or not the ambient humidity is lower than the reference humidity. When the ambient humidity is too high, dew condensation may occur on a front portion of the refrigerator body 110, thereby preventing dew from being condensed when a larger flow rate of refrigerant flows into the hot line 211'. The reference humidity is a reference of an ambient humidity at which dew condensation easily occurs. The reference humidity may be set to 80%, for example. When an ambient temperature is higher than the reference humidity (NO), a dew condensation prevention operation is selected to supply sufficient refrigerant to the hot line 211'. When the first outlet 212*a* is open and the second outlet 212*b* and third outlet 212*c* are closed by the operation of the 4-way valve 200, refrigerant flows into the freezing chamber evaporator 182 through the first capillary 212*a*'. When the freezing chamber evaporator 182 is operated, the temperature of the freezing chamber 113 may be reduced below a set temperature. Furthermore, as refrigerant flows into the first capillary 212*a*', a flow rate of refrigerant flowing through the hot line 211' may increase to prevent the condensation of dew.

When an ambient temperature is between the first reference temperature and the second reference temperature (YES), and an ambient humidity is lower than the reference humidity (YES), a power consumption enhancement operation is selected. The second outlet 212*b* is open, and the first outlet 212*a* and third outlet 212*c* are closed by the operation of the 4-way valve. The temperature of the freezing chamber 113 may be reduced by the operation of the freezing chamber evaporator 182 that has received refrigerant through the second capillary 212*b*'. Furthermore, the second capillary 212*b*' may have a smaller inner diameter than that of the first outlet 212*a*, thereby allowing the power consumption enhancement operation to obtain a power consumption enhancement effect through a flow rate reduction of refrigerant circulating through the freezing cycle.

When the refrigerator 100 according to the present disclosure and an operation method thereof are applied through the foregoing operations, it may be possible to selectively implement a power consumption reduction operation, a fast load response operation, a passage blockage prevention operation, a dew condensation prevention operation, and the like of the refrigerator according to the temperature and humidity.

According to the present disclosure having the foregoing configuration, a 4-way valve may selectively supply refrigerant to three capillaries connected to the 4-way valve. Selectively supplying refrigerant denotes supplying refrigerant to any one capillary, any two capillaries, or three capillaries.

Furthermore, as the 4-way valve is employed, the present disclosure may connect two capillaries to the freezing cycle to dualize a capillary. The dualized capillary have a different inner diameter, and thus the present disclosure may determine a flow rate of refrigerant circulating the freezing cycle according to which capillary is selected as a refrigerant flow passage. Furthermore, the present disclosure may control a flow rate flowing through the freezing cycle to implement various operations required for the refrigerator.

Specifically, an operation implemented by the present disclosure may be (1) an operation for reducing power consumption, (2) a fast load response operation, (3), a passage blockage prevention operation, and (4) a dew condensation prevention operation. In addition, an operation that can be used in a refrigerator may be extended according to controlling a flow rate of refrigerant circulating the freezing cycle.

Furthermore, the present disclosure may be configured to control the operation of the refrigerator based on a temperature of the refrigerating chamber, a temperature of the freezing chamber, a temperature of the outside air and a humidity of the outside air, thereby properly controlling the operation of the refrigerator.

What is claimed is:

1. A refrigerator, comprising:

a compressor that is configured to compress refrigerant;

a condenser that is configured to condense refrigerant;

a refrigerating chamber evaporator that is configured to exchange heat with air in a refrigerating chamber by evaporating refrigerant;

a freezing chamber evaporator that is configured to exchange heat with air in a freezing chamber by evaporating refrigerant;

a first capillary that is configured to reduce refrigerant pressure, that defines a first refrigerant passage by connecting to the freezing chamber evaporator, and that has a first inner diameter;

a second capillary that is configured to reduce refrigerant pressure, that defines a second refrigerant passage by connecting to the freezing chamber evaporator, and that has a second inner diameter that is less than the first inner diameter of the first capillary;

a third capillary that is configured to reduce refrigerant pressure and that defines a third refrigerant passage by connecting to the refrigerating chamber evaporator; and a 4-way valve that includes an inlet that is connected to the condenser, a first outlet that is connected to the first capillary, a second outlet that is connected to the second capillary, and a third outlet that is connected to the third capillary, and that is configured to selectively distribute refrigerant to at least one of the first capillary, the second capillary, or the third capillary based on opening and closing of the first outlet, the second outlet, or the third outlet, wherein the refrigerator is set to a first reference temperature that prevents passage blockage, a second reference temperature that decreases load response time, and a reference humidity that prevents water condensation, and wherein the refrigerator comprises a controller that is configured to operate the 4-way valve to open the second outlet based on a temperature of the freezing chamber being above a set temperature of the freezing chamber, an ambient temperature being between the first reference temperature and the second reference temperature, and an ambient humidity being lower than the reference humidity.

2. The refrigerator of claim 1, wherein:

the first capillary is configured to set a first flow rate of refrigerant flowing to the freezing chamber evaporator, the first flow rate being based on the first inner diameter of the first capillary, and the second capillary is configured to set a second flow rate of refrigerant flowing to the freezing chamber evaporator, the second, different flow rate being based on the second inner diameter of the second capillary.

3. The refrigerator of claim 1, wherein the second inner diameter of the second capillary is greater than 0.7 mm.

4. The refrigerator of claim 1, wherein the first inner diameter of the first capillary is greater than 0.9 mm.

5. The refrigerator of claim 1, further comprising:

a sensing unit that is configured to measure at least one of a temperature of the refrigerating chamber, a temperature of the freezing chamber, a temperature of the outside air, or a humidity of the outside air, wherein the controller is further configured to control the 4-way valve based on a comparison of one or more measurements by the sensing unit with a reference measurement or a set measurement.

6. A refrigerator, comprising:

a compressor that is configured to compress refrigerant;

a condenser that is configured to condense refrigerant;

a refrigerating chamber evaporator that is configured to exchange heat with air in a refrigerating chamber by evaporating refrigerant;

a freezing chamber evaporator that is configured to exchange heat with air in a freezing chamber by evaporating refrigerant;

a first capillary that is configured to reduce refrigerant pressure, that defines a first refrigerant passage by connecting to the freezing chamber evaporator, and that has a first inner diameter;

a second capillary that is configured to reduce refrigerant pressure, that defines a second refrigerant passage by connecting to the freezing chamber evaporator, and that has a second inner diameter that is less than the first inner diameter of the first capillary;

a third capillary that is configured to reduce refrigerant pressure and that defines a third refrigerant passage by connecting to the refrigerating chamber evaporator; and a 4-way valve that includes an inlet that is connected to the condenser, a first outlet that is connected to the first capillary, a second outlet that is connected to the second capillary, and a third outlet that is connected to the third capillary, and that is configured to selectively distribute refrigerant to at least one of the first capillary, the second capillary, or the third capillary based on opening and closing of the first outlet, the second outlet, or the third outlet, wherein the refrigerator is set to a first reference temperature that prevents passage blockage, a second reference temperature that decreases load response time, and a reference humidity that prevents water condensation, and wherein the refrigerator comprises a controller that is configured to operate the 4-way valve to open the first outlet based on a temperature of the freezing chamber being above a set temperature of the freezing chamber, and an ambient temperature being less than the first reference temperature or greater than the second reference temperature.

7. The refrigerator of claim 1, further comprising:

a hot line that defines a refrigerant passage between the condenser and the 4-way valve, and that is configured to prevent water from condensing on a front portion of a refrigerator body, by passing through the front portion of the refrigerator body, wherein a flow rate of refrigerant flowing through the hot line is set based on an inner diameter of a capillary selected as a refrigerant flow passage by the 4-way valve.

8. The refrigerator of claim 7, wherein the controller is further configured to operate the 4-way valve to open the first outlet based on a temperature of the freezing chamber being above a set temperature of the freezing chamber, an ambient temperature being between the first reference temperature and the second reference temperature, and an ambient humidity being above the reference humidity.

9. The refrigerator of claim 1, wherein the 4-way valve comprises a valve pad that is configured to distribute refrigerant to the first outlet, the second outlet, and the third outlet by selectively opening or closing the first outlet, the second outlet, and the third outlet by rotating, and the valve pad comprises:

a base portion that faces the first outlet, the second outlet, and the third outlet; and a protrusion portion that protrudes from the base portion and that is configured to block at least one of the first outlet, the second outlet, or the third outlet based on rotation of the valve pad, wherein the valve pad is configured to selectively implement:

a full closed mode in which the protrusion portion closes the first outlet, the second outlet, and the third outlet, a first mode in which two of the first outlet, the second outlet, or the third outlet are closed, a second mode in which one of the first outlet, the second outlet, or the third outlet is closed, and a third mode in which none of the first outlet, the second outlet, or the third outlet are closed.

10. The refrigerator of claim 9, wherein the protrusion portion includes a first portion that is configured to block the first outlet, a second portion that is configured to block the second outlet, and a third portion that is configured to block the third outlet in the full closed mode, and the valve pad defines a recess portion that is located between the first portion and the second portion and that is configured to open the first outlet based on switching from the full closed mode to the second mode.

11. The refrigerator of claim 10, wherein the base portion is divided into a first quadrant that includes the first portion, a second quadrant that includes the second portion, a third quadrant that includes the third portion, and a fourth quadrant, the first quadrant, the second quadrant, the third quadrant, and the fourth quadrant being located sequentially around a center of the base portion.

12. The refrigerator of claim 11, wherein the first outlet, second outlet, and third outlet are located in the first quadrant, the second quadrant, and the third quadrant, respectively, in the full closed mode.

13. The refrigerator of claim 11, wherein a connection between the second portion and the third portion defines a protrusion from the base portion over a boundary between the second quadrant and the third quadrant and along a circumferential direction.

14. The refrigerator of claim 11, wherein a connection between the first portion and the third portion defines a protrusion that is located in the fourth quadrant and that is smaller than the first portion, the second portion, and the third portion.

15. The refrigerator of claim 14, wherein:

a second recess portion is located between the protrusion that is located in the fourth quadrant and the first portion, and a third recess portion is located between the protrusion that is located in the fourth quadrant and the third portion.

16. The refrigerator of claim 10, wherein the fourth quadrant includes a position setting portion that identifies the fourth quadrant that does not include the first portion, the second portion, or the third portion.

17. The refrigerator of claim 15, wherein the position setting portion is a flat edge on the perimeter of the valve pad.

18. The refrigerator of claim 10, wherein:

a portion of the first portion is defined by a first arc that is defined by a radius, a portion of the second portion is defined by a second arc that is defined by the radius, and a portion of the third portion is defined by the second arc, wherein the second arc is shorter than the first arc.

19. The refrigerator of claim 9, wherein the valve pad defines a hole that is in a center of the valve pad.

* * * * *